US005912101A

United States Patent [19]

Karaki et al.

[11] Patent Number: 5,912,101

[45] Date of Patent: Jun. 15, 1999

[54] TONER FOR FORMING AN IMAGE, IMAGE FORMING METHOD AND HEAT-FIXING METHOD

[75] Inventors: Yuki Karaki, Shizuoka-ken; Hiroshi Yusa, Machida; Takashige Kasuya, Soka; Kazuo Maruyama, Mishima; Masao Takano, Susono, all of Japan

[73] Assignee: Canon Kabushiki Kaisha, Tokyo, Japan

[21] Appl. No.: 09/055,317

[22] Filed: Apr. 6, 1998

[30] Foreign Application Priority Data

| | | | |
|---|---|---|---|
| Apr. 4, 1997 | [JP] | Japan | 9-086165 |
| Jun. 18, 1997 | [JP] | Japan | 9-160793 |
| Nov. 17, 1997 | [JP] | Japan | 9-315698 |

[51] Int. Cl.[6] ..... G03G 9/097; G03G 13/22

[52] U.S. Cl. ..... 430/110; 430/111; 430/124; 430/126

[58] Field of Search ..... 430/110, 111, 430/124, 126

[56] References Cited

U.S. PATENT DOCUMENTS

| | | | |
|---|---|---|---|
| 4,950,575 | 8/1990 | Shiozaki et al. | 430/110 |
| 4,957,774 | 9/1990 | Doi et al. | 430/106.6 |
| 5,086,728 | 2/1992 | Kinoshita | 399/281 |
| 5,240,803 | 8/1993 | Ota | 430/110 |
| 5,264,902 | 11/1993 | Suwa et al. | 399/333 |
| 5,280,328 | 1/1994 | Goto et al. | 399/70 |
| 5,285,245 | 2/1994 | Goto et al. | 399/322 |
| 5,289,247 | 2/1994 | Takano et al. | 399/68 |
| 5,512,729 | 4/1996 | Kusaka et al. | 219/216 |
| 5,529,871 | 6/1996 | Ichimura et al. | 430/106 |
| 5,532,806 | 7/1996 | Sugita et al. | 399/328 |
| 5,552,582 | 9/1996 | Abe et al. | 219/619 |
| 5,552,874 | 9/1996 | Ohtsuka et al. | 399/335 |
| 5,572,306 | 11/1996 | Goto et al. | 399/69 |
| 5,679,491 | 10/1997 | Oshiba et al. | 430/110 |
| 5,712,072 | 1/1998 | Inaba et al. | 430/111 |

FOREIGN PATENT DOCUMENTS

| | | |
|---|---|---|
| 0 397 501 | 11/1990 | European Pat. Off. . |
| 0 541 375 | 5/1993 | European Pat. Off. . |
| 58-42057 | 3/1983 | Japan . |
| 1-112253 | 4/1989 | Japan . |
| 2-284158 | 11/1990 | Japan . |
| 5-061350 | 3/1993 | Japan . |
| 6-138774 | 5/1994 | Japan . |
| 6-317931 | 11/1994 | Japan . |

*Primary Examiner*—Roland Martin

*Attorney, Agent, or Firm*—Fitzpatrick, Cella, Harper & Scinto

[57] ABSTRACT

A toner for forming an image has toner particles containing at least a colorant, a binder resin and a wax. The toner has (i) a circularity distribution in which the toner has an average circularity of 0.900 to less than 0.965, contains 20 to 60% by number of particles with a circularity of less than 0.95 and has a mode circularity of 0.90 or more; and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm. The wax has an endothermic main peak as measured by DSC of 60 to 120° C. The binder resin contains THF soluble matter and 0 to 5.0% by weight of THF insoluble matter. The THF soluble matter having a molecular-weight distribution as measured by GPC in which the THF soluble matter has a content (M1) of 5% or less of a component with a molecular weight of less than 50,000, a content (M2) of 20 to 45% of a component with a molecular weight of 50,000 to 500,000, and a content (M3) of 2 to 25% of a component with a molecular weight exceeding 500,000 and the following condition (1) is satisfied:

$$M1 \geq M2 > M3 \quad (1)$$

64 Claims, 12 Drawing Sheets

TONER FOR FORMING AN IMAGE, IMAGE FORMING METHOD AND HEAT-FIXING METHOD

BACKGROUND OF THE INVENTION

1. Field of the Invention

This invention relates to a toner for forming an image, and an image forming method and a heat fixing method, used in recording processes that utilize electrophotography, electrostatic recording, magnetic recording or the like. More particularly, this invention relates to a toner for forming an image, and an image forming method, used in an image forming apparatus such as copying machines, printers, facsimile machines and so forth in which a toner image is previously formed on an electrostatic latent image bearing member, the toner image is thereafter transferred to a transfer medium and the toner image transferred is fixed on a recording medium to form an image.

2. Related Background Art

A number of methods are conventionally known for electrophotography. Final images such as copies or prints are commonly obtained by forming an electrostatic latent image on a photosensitive member by utilizing a photoconductive material and by various means, subsequently developing the electrostatic latent image by the use of a toner to make it visible to form a toner image, transferring the toner image to a transfer medium such as paper if necessary, and thereafter fixing the toner image to the transfer medium by heat or pressure.

As methods of visualizing an electric latent image, a cascade development method, a magnetic brush development method and a pressurizing development method are known. In another known method, a magnetic toner and a rotating sleeve with a magnetic pole disposed in a center thereof are used, so that the magnetic toner is allowed to fly in an electric field between a photosensitive member and the rotating sleeve.

As printers, LED printers and LBP printers are prevailing in the recent market. As a trend of techniques, there is a tendency toward higher resolution. That is, those which hitherto have a resolution of 240 or 300 dpi are being replaced by those having a resolution of 400, 600 or 800 dpi. Accordingly, with such a trend, the developing systems are now required to achieve a higher minuteness. Copying machines have also made progress to have higher functions, and hence they trend toward digital systems. The digital systems chiefly employ a method in which electrostatic latent images are formed by using a laser, and hence, the copying machines also trend toward a high resolution and, like the printers, it has been sought to provide a developing system with high resolution and high minuteness. For this reason, as a trend of techniques, there is a tendency toward smaller particle diameter of toner. Japanese Patent Application Laid-Open No. 1-112253 and No. 2-284158 propose toner having smaller particle diameter in the specific particle diameter distribution.

Recently, a tendency is thus proceeding toward a high resolution. However, since a toner circularity is not regulated, a density of developed toner particles tend to become coarse. There arises a problem that trailing phenomenon (i.e. smeared image trailing edge) easily occurs in a non-image portion in the latter half of a developed image. Further, an external additive cannot uniformly adhere to a toner surface. Therefore, another problem lies in shelf life (or storability) of the toner at high temperature and humidity.

In a general method of manufacturing the toner, a dye or a pigment as a colorant is molten and kneaded in a binding resin constituted of, e.g., a thermoplastic resin, and uniformly dispersed therein. Thereafter, a jet air current grinding is performed by using a jet air current. Especially, pulverizing is performed with a pulverizing device like an impingement air current pulverizer. Further, resulting powder is classified with a classifier to manufacture a powder having a desired particle diameter. The method is mainly used at present because of its mass productivity and cost effectiveness.

For example, when a toner with an average particle diameter of 6 μm is obtained by using the pulverizer, in a particle size distribution of the pulverized toner, about 0.6 μm to 10 μm particles including multiple fine particles are distributed. In a classification process, the fine particles are removed before obtaining a toner product. However, ultrafine particles with a particle diameter of 1 μm or less have a strong adhesion force to particles. The ultrafine particles behave while adhering to larger particles. Therefore, it is difficult to completely remove the ultrafine particles in a usual classification process.

Many proposals have been heretofore put forth to remove fine toner powder or suppress the generation thereof. However, it has been heretofore difficult to exactly measure the distribution of particle diameters of 1.0 μm or less without being influenced by noises. Therefore, the toner ultrafine particles with particle diameters of 1 μm or less are not clearly described. For example, in the Japanese Patent Application Laid Open No. 58-42057 and No. 6-317931, an objective fine powder is in the range of 5 μm or less, and the toner ultrafine particles with particle diameters of 1 μm or less are not clearly described.

When many ultrafine particles with particle diameters of 1 μm or less are present, there is a large difference in toner electrification quantity between an initial condition and a long-run condition. Accordingly, there arises a phenomenon that a toner transferability is varied.

When the phenomenon arises, during formation of a full-color image a four-color toner image is not uniformly transferred. An irregular color or a problem about a color balance easily occurs. It is not easy to stabilize an output of the full-color image of a high quality.

Additionally, the ultrafine particles with particle diameters of 1 μm or less are easily deposited on a toner carrier surface or a latent image bearing member surface. Further in the case where a resin with a low softening point is used or in another case, the deposited ultrafine particles tend to form a film, thereby causing an image defect.

Further, in recent years printing is performed at a high speed and fixing is performed with a low energy. Therefore, as a binder resin of a toner, a resin which softens at low temperatures is mainly used. The resin generally has a high grindability. Therefore, the ultrafine particles with particle diameters of 1 μm or less tend to be easily generated. Further, since the resin softens at low temperatures, the particles tend to be easily deposited on the toner carrier surface or the latent image bearing member surface or to easily form a film.

SUMMARY OF THE INVENTION

Wherefore, an object of the invention is to solve the aforementioned problems with the prior art and provide a toner for forming an image.

Another object of the invention is to provide a toner for forming an image which is faithful to an original, a signal and a latent image and which substantially has no trailing (i.e. smeared image trailing edge).

Still another object of the invention is to provide a toner for forming an image to whose surface an external additive uniformly adheres, which does not lose its flowability even in a high temperature and humidity environment and which is superior in storability.

Further object of the invention is to provide a toner for forming an image which has a high transferability from an initial condition till a long-run condition (after endurance run) and which has only a small variation in transferability.

Another object of the invention is to provide a toner for forming an image which is prevented from making dirty a toner carrier surface or a latent image bearing member surface, which has a high transferability and from which a long-life, highly durable and highly precise image can be stably obtained without lowering an image density, causing a fog or deteriorating another image quality.

Further object of the invention is to provide an image forming method and a heat-fixing method in which the improved toner for forming an image is used.

To attain these and other objects, the present invention provides a toner for forming an image which comprises toner particles containing at least a colorant, a binder resin and a wax.

The toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm.

The wax has an endothermic main peak as measured by DSC of 60 to 120° C.

The binder resin contains THF soluble matter and O to 5.0% by weight of THF insoluble matter. In a molecular-weight distribution of the THF soluble matter as measured by GPC, the THF soluble matter has a content (M1) of 40 to 70% of a component with a molecular weight of less than 50,000, a content (M2) of 20 to 45% of a component with a molecular weight of 50,000 to 500,000, and a content (M3) of 2 to 25% of a component with a molecular weight exceeding 500,000. Additionally, the following condition (1) is satisfied:

$$M1 \geqq M2 > M3 \quad (1)$$

The invention also provides an image forming method which comprises the steps of:

a latent image forming process for forming an electrostatic latent image on an electrostatic latent image holding member;

a development process for developing the electrostatic latent image held by the electrostatic latent image holding member with a toner to form a toner image;

a transfer process for transferring the toner image to a recording material via or not via an intermediate transfer member; and a fixing process for fixing onto the recording material the toner image transferred to the recording material.

In the method, the toner comprises toner particles containing at least a colorant, a binder resin and a wax.

The toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and h as at least one peak of frequency by number in the region of a circle-equivalent diameter of 0.6 to 3.0 μm and at least one peak of frequency by number in the region of a circle-equivalent diameter of from more than 3.0 μm to 10.0 μm.

The wax has an endothermic main peak as measured by DSC of 60 to 120° C.

The binder resin contains THF soluble matter and 0 to 5.0% by weight of THF insoluble matter. In a molecular-weight distribution of the THF soluble matter as measured by GPC, the THF soluble matter has a content (M1) of 40 to 70% of a component with a molecular weight of less than 50,000, a content (M2) of 20 to 45% of a component with a molecular weight of 50,000 to 500,000, and a content (M3) of 2 to 25% of a component with a molecular weight exceeding 500,000. Additionally, the following condition (1) is satisfied:

$$M1 \geqq M2 > M3 \quad (1)$$

The invention further provides a heat-fixing method which comprises the steps of:

an image forming process for forming a toner image with a toner on a recording material; and a fixing process for heat-fixing onto the recording material the toner image formed on the recording material.

In the method, the toner comprises toner particles containing at least a colorant, a binder resin and a wax.

The toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm.

The wax has an endothermic main peak as measured by DSC of 60 to 120° C.

The binder resin contains THF soluble matter and 0 to 5.0% by weight of THF insoluble matter. In a molecular-weight distribution of the THF soluble matter as measured by GPC, the THF soluble matter has a content (M1) of 40 to 70% of a component with a molecular weight of less than 50,000, a content (M2) of 20 to 45% of a component with a molecular weight of 50,000 to 500,000 and a content (M3) of 2 to 25% of a component with a molecular weight exceeding 500,000. Additionally, the following condition (1) is satisfied:

$$M1 > M2 > M3 \quad (1)$$

DETAILED DESCRIPTION OF THE INVENTION

Figure 1:
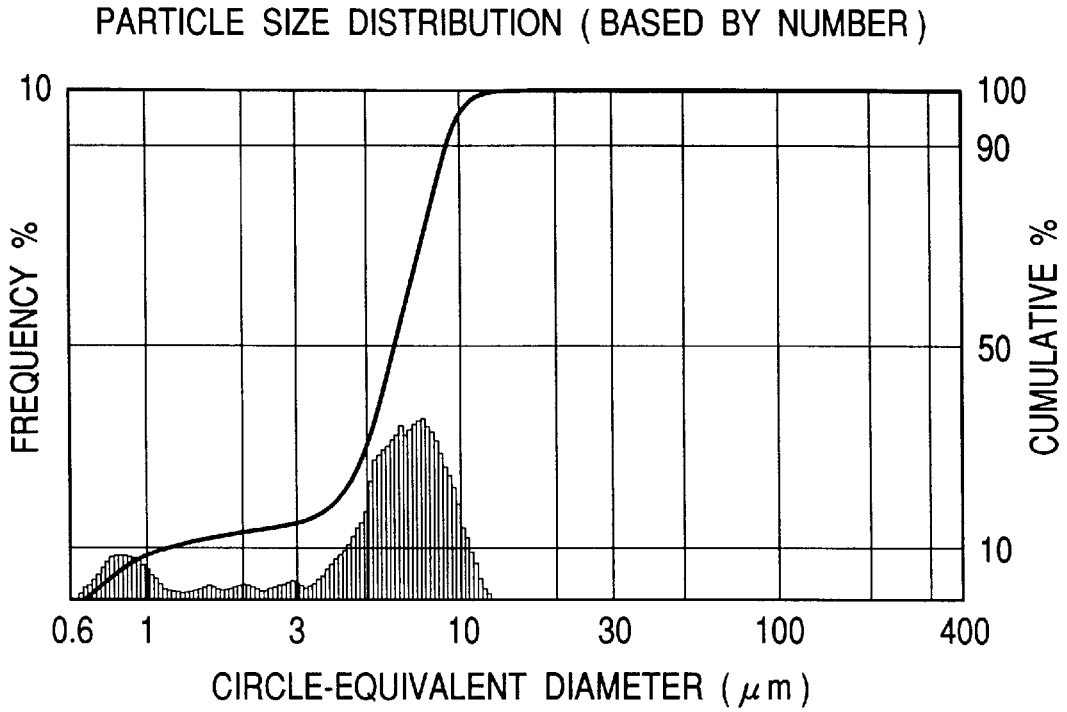
FIG. 1 is a diagram showing a particle size distribution of a toner in a first embodiment.

The inventors have found that a proportion of particles with particle diameters of 1.0 μm or less in a particle size distribution in a circle-equivalent diameter of toner particles is largely related with an electrophotography characteristic to develop the present invention.

The circularity referred to in the present invention is used as a simple way to quantitatively describe the shape of particles. In the present invention, measurement is made using a flow type particle image analyzer FPIA-1000, manufactured by Toa Iyoudenshi K. K., and a value found from the following expression is defined to be the circularity.

$$\text{Circularity } a = Lo/L$$

wherein Lo represents a circumferential length of a circle having the same projected area as a particle image, and L represents a circumferential length of a projected image of a particle.

The circularity referred to in the present invention is an index of the degree of irregularities in the surface of a toner particle. It is indicated as 1.00 when a toner particle is perfectly spherical, and the circularity is indicated by a smaller value as the surface has a more complicated shape.

According to the invention, in a toner circularity distribution as measured by using a flow particle image analyzing device, a toner has an average circularity of 0.900 to 0.965, preferably 0.930 to 0.960, contains 20 to 60%, preferably 20 to 50% by number of particles with a circularity of less than 0.95, and has a mode circularity of 0.90 or more, preferably 0.93 or more. Thereby, the aforementioned problem can be solved.

Further, even when a fixing speed is as fast as 120 mm/sec or more, the toner of the invention in a non-fixed toner image is dense. Therefore, a trailing phenomenon (i.e., smeared image trailing edge) of the toner hardly occurs by evaporation water from paper at the time of fixing. Further, since at the time of fixing a good thermal conductivity is obtained, a fixing trailing hardly occurs.

If the average circularity of the toner is less than 0.900, the developed toner particles tend to become coarse. At the time of fixing the non-fixed toner image, the trailing phenomenon easily occurs in the image recording material or the non-image portion on the downstream side of a conveyance direction. If the average circularity of the toner exceeds 9.965, a cleaning defect easily occurs. If the content of toner particles with a circularity of less than 0.95 is less than 20% by number, the cleaning defect easily occurs. If the content of toner particles with a circularity of less than 0.95 exceeds 60% by number, the developed toner particles tend to become coarse. At the time of fixing the non-fixed toner image, the trailing phenomenon easily occurs in the image recording material or the non-image portion on the downstream side of the conveyance direction. If the mode circularity is less than 0.90, similarly the developed toner particles tend to become coarse. At the time of fixing the non-fixed toner image, the trailing phenomenon easily occurs in the image recording material or the non-image portion on the downstream side of the conveyance direction.

According to the invention, in a particle size distribution the toner has a circle-equivalent average diameter of 2.0 to 10.0 μm, at least one peak of frequency (%) by number in the region of a circle-equivalent diameter of 0.6 to 3.0 μm and at least one peak of frequency by number in the region of a circle-equivalent diameter of from more than 3.0 μm to 10.0 μm. Therefore, the storability of the toner at high temperature and humidity is excellent. Specifically, since the toner has peaks in different circle-equivalent average diameters, the external additive densely adheres to the toner. As a result, the storability of the toner at high temperature and humidity is enhanced. If the circle-equivalent average diameter is less than 2 μm, the cleaning defect is generated. If the circle-equivalent average diameter exceeds 10.0 μm, the developed toner particles tend to become coarse. At the time of fixing the non-fixed toner image, the trailing phenomenon easily occurs in the toner image recording material or the non-image portion on the downstream side of the conveyance direction.

The toner of the invention needs to have a wax which has one or more endothermic peaks as measured by differential thermal analysis in the range of from 60 to 120° C.

When the endothermic peak in the differential thermal analysis of the wax exists in the range of from 60 to 120° C., the compatibility of the wax with a binder resin for use in the invention is excellent. Further, the development property at high temperature and humidity is excellent.

If there is at least one endothermic peak in the differential thermal analysis between 60° C. and 120° C., an effect is obtained. Further, the endothermic peak may exist in the range exceeding 120° C.

The waxes may include petroleum waxes such as paraffin wax, microcrystalline wax and petroleum wax, and derivatives thereof; mountain wax and derivatives thereof; hydrocarbon waxes obtained by the Fischer-Tropsch process, and derivatives thereof; polyolefin waxes as typified by polyethylene, and derivatives thereof; natural waxes such as carnauba wax and candelilla wax, and derivatives thereof; alcohols such as higher aliphatic alcohols; fatty acids such as stearic acid and palmitic acid, and derivatives thereof; acid amides, esters and ketones, and derivatives thereof; hardened castor oil and derivatives thereof; vegetable waxes; and animal waxes. The derivatives may include oxides, and block copolymers or graft modified products with vinyl monomers.

The molecular weight distribution of the wax according to the present invention is measured under conditions shown below.

GPC measurement conditions

Apparatus: GPC-150C (Waters Co.)

Columns: GMH-HT 30 cm, two series (available from Tosoh Corporation)

Temperature: 135° C.

Solvent: o-Dichlorobenzene (0.1 wt. % ionol-added)

Flow rate: 1.0 ml/min

Sample: 0.4 ml of sample with a concentration of 0.15 wt. % is injected.

Measured under conditions shown above. Molecular weight of the sample is calculated using a molecular weight calibration curve prepared from a monodisperse polystyrene standard sample. It is calculated by further polyethylene converting the value according to a conversion formula derived from the Mark-Houwink viscosity formula.

Further, in the toner of the invention, a ratio Mw/Mn of the contained wax between a weight-average molecular weight Mw and a number-average molecular weight Mn is 1.0 to 2.0. In this case, since the toner is readily soluble, an excellent fixing property can be obtained even at low temperatures. The trailing is further effectively suppressed.

Figure 10:
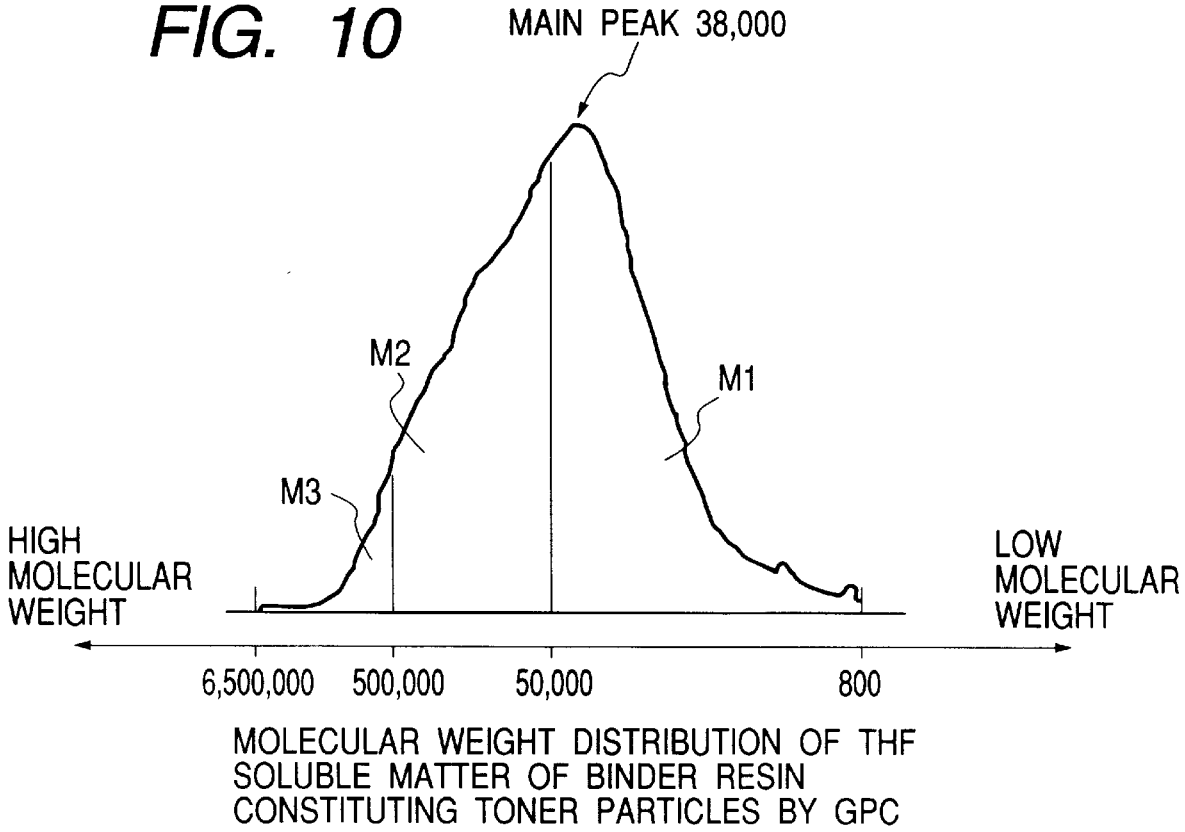
FIG. 10 is a chart diagram showing a molecular-weight distribution as measured by GPC of a THF soluble matter of a binder resin in the toner of the first embodiment.

Additionally, the binder resin for use in the toner according to the present invention contains 0 to 5% by weight of a THF insoluble matter. In a GPC molecular-weight distribution of a THF soluble matter, as shown in FIG. 10, the THF soluble matter has a content M1of 40 to 70% of a component with a molecular weight of less than 50,000, a content M2 of 20 to 45% of a component with a molecular weight of 50,000 to 500,000 and a content M3of 2 to 25% of a component with a molecular weight exceeding 500,000. Additionally, the relationship $M1 \geqq M2 > M3$ needs to be satisfied.

Since the THF insoluble matter is 0 to 5% by weight and the content M1 of the component with the molecular weight of less than 50,000 is 40 to 70%, an excellent fixing property at low temperatures is obtained. As a result, the trailing is effectively suppressed. Further, since the content M2 of the component with the molecular weight of 50,000 to 500,000 is 20 to 45% and the content M3 of the component with the molecular weight exceeding 500,000 is 2 to 25%, a long storability of the toner at high temperature and humidity is obtained without impairing the fixing property.

If the THF insoluble matter exceeds 5% by weight and the content M3 of the component with the molecular weight exceeding 500,000 exceeds 25%, the fixing property at low temperatures is deteriorated. If the content M1 of the component with the molecular weight of less than 50,000 exceeds 70% and the relationship $M1 \geqq M2 > M3$ is not satisfied, there arises a problem in the toner storability at high temperature and humidity and a high temperature offset.

The molecular weight of the THF soluble matter of the binder resin is measured by gel permeation chromatography (GPC). Specifically, in the GPC measurement method, a sample is prepared beforehand by extracting the toner in a THF (tetrahydrofuran) solvent for 20 hours by using Soxhlet extractor. In a column constitution, columns A-801, 802, 803, 804, 805, 806 and 807 manufactured by Showa Denko are interconnected. Then, by using a working curve of standard polystyrene resin, a molecular-weight distribution is measured. For the content M1 of the component with the molecular weight of less than 50,000, the content M2 of the component with the molecular weight of 50,000 to 500,000 and the content M3 of the component with the molecular weight exceeding 500,000, an area ratio in a GPC chromatogram is represented by weight %. Additionally, the lower limit in the range of the molecular weight of the content M1 of the component with the molecular weight less than 50,000 is set to the molecular weight of 800 by considering noises at the time of measuring the molecular weight.

The THF insoluble matter of the binder resin is represented by a weight percentage of a super-high molecular polymer component (substantially the cross-linked polymer) which is insoluble in the THF solvent. The THF insoluble matter of the binder resin is defined by a value measured as follows.

About 1 g of binder resin is weighed ($W_1$g), placed in a cylindrical filter paper (e.g., No. 86 manufactured by Toyo Roshi) and set in Soxhlet extractor. By using 100 to 200 ml of THF as a solvent, extraction is performed for six hours. After evaporating a soluble component extracted by the THF solvent, vacuum-drying is performed at 100° C. for several hours. Then, a THF soluble resin content is weighed ($W_2$g). The THF insoluble matter of the binder resin is calculated from the following equation:

$$\text{THF insoluble matter (wt \%) of binder resin} = (W_1 - W_2)/W_1 \times 100$$

After a melting/kneading process for preparing toner particles, the THF insoluble matter of the binder resin in a raw-material stage and its molecular-weight distribution are changed in some case. In this case, the molecular-weight distribution of the THF soluble matter of the binder resin constituting the toner particles needs to be measured. Also, the THF insoluble matter needs to be measured.

For the THF soluble matter of the binder resin constituting the toner particles, the toner is set in Soxhlet extractor of toluene. Toluene soluble content is extracted. An extracted liquid is solidified, and then separated by using THF.

For the THF insoluble matter of the binder resin constituting the toner particles, about 1g of the toner is weighed ($W_3$g), placed in a cylindrical filter paper (e.g., No. 86R manufactured by Toyo Roshi) and set in Soxhlet extractor. By using 100 to 200 ml of THF as a solvent, extraction is performed for six hours. After evaporating a soluble component extracted by the THF solvent, vacuum-drying is performed at 100° C. for several hours. Then, a THF soluble resin content is weighed ($W_4$g). The weight of the colorant (magnetic substance), the wax and other components in the toner except the binder resin is measured beforehand as $W_5$g. The THF insoluble matter is obtained from the following equation:

$$\text{THF insoluble matter (\% by weight)} = (W_3 - (W_5 + W_4))/(W_3 - W_5) \times 100$$

As the binder resin used in the present invention, it is possible to use, e.g., styrene and homopolymers of its substitution products, such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is also a preferred binder resin.

As comonomers copolymerizable with styrene monomers in the styrene copolymers, any of these vinyl monomers may be used alone or in combination. The comonomers may include monocarboxylic acids having a double bond and substitution products thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substitution products thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether.

Here, as a cross-linking agent, a compound having at least two polymerizable double bonds may be used. Any of these may be used alone or in the form of a mixture. For example, it may include aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups.

In the invention, the toner contains the wax which has an endothermic peak in the differential thermal analysis in the region of from 60 to 120° C. The THF insoluble matter of the binder resin is 0 to 5% by weight. In the GPC molecular-weight distribution of the THF soluble matter, the content M1 of the component with the molecular weight of less than 50,000 is 40 to 70%, the content M2 of the component with the molecular weight of 50,000 to 500,000 is 20 to 45% and the content M3 of the component with the molecular weight exceeding 500,000 is 2 to 25%. Additionally, the relationship $M1 \geqq M2 > M3$ is satisfied. In a circularity distribution the toner has an average circularity of 0.900 to less than 0.965, contains 20 to 60% by number of particles with a circularity of less than 0.95 and has a mode circularity of 0.90 or more. In a particle size distribution the toner has a circle-equivalent average diameter of 2 to 10.0 μm and has at least one peak of frequency (%) by number in each of the region of a circle-equivalent diameter of 0.6 to 3.0 μm and the region of a circle-equivalent diameter of from more than 3.0 μMm to 10.0 μm. Thereby, the trailing is suppressed. Additionally, the storability of the toner at high temperature and humidity can be enhanced.

According to the invention, in a particle size distribution by means of a particle circle-equivalent diameter as measured by using the flow particle image analyzing device, the toner has a frequency by number of 2 to 50%, preferably of 5 to 40% in the region of the circle-equivalent diameter of 0.95 to less than 3.00 μm. In the toner circle-equivalent diameter of 0.95 to less than 3.00 μm, if the frequency by number is less than 2%, the developed toner particles tend to become coarse. The trailing easily occurs. In the toner circle-equivalent diameter of 0.95 to less than 3.00 μm, if the frequency by number exceeds 50%, the suppression of a fog in a solid white image is disadvantageously deteriorated.

The toner of the invention has toner particles containing at least the colorant, the binder resin and the wax a nd an external additive. The external additive preferably includes fine inorganic particles. Since the fine inorganic particles are hardly influenced by the environment, they are used as the external additive. Even at high temperature and humidity, the flowability of the toner is not deteriorated. Additionally, the storability of the toner is not deteriorated.

In the particle size distribution in the circle-equivalent diameter of the toner particles according to the invention, a proportion of particles with a circle-equivalent diameter of 0.60 μm to less than 1.00 μm is preferably 0 to 5.0% by number in an entire number distribution. If 5.0% by number or more particles with the circle-equivalent diameter of 0.60 μm to less than 1.00 μm exist, a large difference is made in toner electrification quantity between the initial condition and the long-run condition. Accordingly, the toner transferability tends to be varied. Ultrafine particles are easily deposited on the toner carrier surface. Further, when the resin with a low softening point is used, the deposited ultrafine particles tend to form a film. As a result, the image is made dirty. A problem occurs in stability of the toner electrification quantity. The image density is lowered because of a decrease of transferability. Additionally, a fog and other many image characteristics are easily influenced.

Further, the circle-equivalent average diameter of the toner particles is preferably 4.0 to 10.0 μm. If the circle-equivalent average particle diameter exceeds 10.0 μm, it is difficult to obtain a highly precise image stably. If the circle-equivalent average particle diameter is less than 4.0 μm, it is difficult to obtain a high-quality image stably over a long time in the present technique.

In the manufacture process of the toner, the toner particles are preferably subjected to a process for reducing the number of particles with a circle-equivalent diameter of less than 1.00 μm. In the process for reducing the number of the toner particles with the circle-equivalent diameter of less than 1.00 μm, a classification process is preferably performed more precisely and/or a process for applying a mechanical impact force is preferably performed.

Specifically, in the process for reducing the number of the toner particles with the circle-equivalent diameter of less than 1.00 μm, for example, the 1.00 μm or finer particles which cannot be removed in the usual toner classification process are forced to be dispersed by using a compressed gas at the time of supplying the toner in the classification process, more precisely classified by operating a classification process means several times, or fixed onto surfaces of large toner particles by applying a mechanical impact force to the particles with the circle-equivalent diameter of less than 1.00 μm which adhere to surfaces of relatively large toner particles (with a circle-equivalent diameter of 1.00 μm or more).

In the particle size distribution in the circle-equivalent diameter of the toner particles according to the invention, to easily achieve the proportion of 0 to 5.0% by number of particles with particle diameters of 0.60 μm to less than 1.00 μm in the entirety, the aforementioned process for reducing the number of the toner particles with the circle-equivalent diameter of less than 1.00 μm is preferably used.

The toner preferably has 90% by number or more of 3.00 μm or larger particles with a circularity a of 0.90 or more, and further preferably has 0 to less than 30.0% by number of the particles with a circularity a of 0.98 or more. When this condition is satisfied, the variation of the transferability is reduced.

For the toner of the invention, the particle size distribution in the circle-equivalent diameter and the circularity distribution are measured as follows by using the flow particle image analyzing device FPIA-1000 (manufactured by Toa Iyou Denshi K. K.):

Into ca. 100 to 150 ml of water from which fine dirt has been removed by passing through a filter so as to reduce the number of contaminant particles (having particle sizes in the measurement range (i.e., circle-equivalent diameters of 0.60 to 159.21 μm)) to at most 20 particles, 0.1 to 0.5 ml of a surfactant (preferably an alkylbenzenesulfonic acid salt solution) is added, followed by ca. 1 to 3 min. of dispersion by means of an ultrasonic disperser, to form a sample dispersion liquid having a concentration of 3,000 to 10,000 particles/$10^{-3}$ $cm^3$ (based on paticles in the measurement range). The sample dispersion liquid is subjected to measurement of particle size distribution in a circle-equivalent diameter range of 0.60 to 159.21 μm (upper limit, not inclusive) and the circularity distribution.

The outline of the measurement (based on a technical brochure and an attached operation manual on "FPIA-1000" published from Toa Iyou Denshi K. K. (June 1995), and JP-A 8-136439) is as follows.

A sample dispersion liquid is caused to flow through a thin transparent flow cell (thickness=Ca. 200 μm) having a divergent flow path A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two-dimensional image having a certain area parallel to the flow cell. From the two-dimensional image area of each particle, a diameter of a circle having an identical area is determined as a circle-equivalent diameter. During ca. 1 min., circle-equivalent diameters of more than 900 particles can be determined, from which a number basis circle-equivalent diameter distribution, and a proportion (% by number) of particles having a prescribed circle-equivalent diameter range can be determined. (As a specific example, in the case of a toner dispersion liquid containing ca. 6,000 particles/$10^{-3}$ $cm^3$, the diameters of ca. 1,800 particles can be determined in ca. 1 min.) The results (frequency % and cumulative %) may be given for 226 channels in the range of 0.60 μm to 400.00 μm (80 channels (divisions) for one octave) as shown in the following Table 1 (for each channel, the lower limit size value is included and the upper limit size value is excluded), whereas particles having circle-equivalent diameters in a range of 0.60 μm to 159.21 μm (upper limit, not inclusive) are subjected to an actual measurement.

According to the invention, in a particle size distribution as measured by Coalter counter, the toner preferably has a volume average particle diameter Dv of 2.5 to 6.0 μm. If the volume average particle diameter Dv is less than 2.5 μm, the image density tends to be lowered. If the volume average particle diameter Dv exceeds 6.0 μm, it is difficult to form a high-quality image.

The particle distribution of the toner of the present invention is measured using Coulter Counter Model TA-II, and Coulter Multisizer (manufactured by Coulter Electronics, Inc.) may be used. As an electrolytic solution, an aqueous 1% NaCl solution is prepared using first-grade sodium chloride. For example, ISOTON R-II (available from Coulter Scientific Japan Co.) may be used. Measurement is carried out by adding as a dispersant from 0.1 to 5 ml of a surface active agent (preferably an alkylbenzene sulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 200 μm by means of the above measuring device, using an aperture of 100 μm as its aperture.

Then, a weight basis volume average particle diameter Dv is obtained from a volume distribution according to the invention (a middle value of each channel is regarded as a representative value of each channel).

Thirteen channels are used: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm.

The toner of the invention is preferably a magnetic toner which contains 30 to 200 parts by weight, preferably 50 to 150 parts by weight of a magnetic substance as the colorant relative to 100 parts by weight of the binder resin.

If the magnetic substance content is less than 30 parts by weight, more particles with the circle-equivalent diameter of less than 1.00 μm are easily generated at the time of grinding. Further, the particles of less than 1.00 μm have a stronger adhesion force to the surfaces of large particles. Therefore, it is difficult to remove the particles of less than 1.00 μm in the usual method. Further, in a development apparatus which uses a magnetic force for conveying the toner, the conveyance property is insufficient. Irregularities tend to be generated on a developer layer on a developer carrying member, thereby resulting in image irregularities. Further, the image density tends to be lowered because of the rising of a developer Toribo. If the magnetic substance content exceeds 200 parts by weight, a problem tends to occur in fixing property.

With regard to the colorant used in the present invention, black colorants may include carbon black, magnetic materials, and colorants so combined as to be toned in black by chromatic colorants such as the yellow colorant, magenta colorant and cyan colorant shown below.

The yellow colorant includes compounds as typified by condensation azo compounds, isoindolinone compounds, anthraquinone compounds, azo metal complexes, methine compounds and allylamide compounds. Stated specifically, C. I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

The magenta colorant includes condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, C. I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

The cyan colorant includes copper phthalocyanine compounds and derivatives thereof, anthraquinone compounds and basic dye lake compounds. Stated specifically, C. I. Pigment Blue 1, 7, 15, 15:1, 15:2, 15:3, 15:4, 60, 62 and 66 may be particularly preferably used.

These colorants may be used alone, in the form of a mixture, or in the state of a solid solution. In the present invention, the colorants are selected taking account of hue angle, chroma, brightness, weatherability, transparency on OHP films and dispersibility in toner particles. Any of these chromatic colorants may be contained in the toner in an amount of from 1 to 20 parts by weight based on 100 parts by weight of the binder resin.

In a case when a magnetic material is used as a black colorant, the black colorant may be contained in an amount of from 30 to 200 parts by weight based on 100 parts by weight of the binder resin, which is different from other colorants.

The magnetic material includes metal oxides containing an element such as iron, cobalt, nickel, copper, magnesium, manganese, aluminum or silicon. In particular, those mainly composed of an iron oxide such as triiron tetraoxide or γ-iron oxide are preferred. In view of the control of charging performance of the toner, the magnetic material may contain another element such as silicon element or aluminum element. These magnetic materials may have a BET specific surface area, as measured by nitrogen gas absorption, of from 2 to 30 $m^2/g$, and particularly from 3 to 28 $m^2/g$, and may preferably magnetic materials having a Mohs hardness of from 5 to 7.

As to the shape of the magnetic material, it may be octahedral, hexahedral, spherical, acicular or flaky. Shapes having less anisotropy such as octahedral, hexahedral, spherical and amorphous are preferred in view of an improvement in image density. Spherical magnetic material is particularly preferred. Further, the magnetic material containing silica is particularly preferred in view of an improvement in image density.

The magnetic material may preferably have an average particle diameter of from 0.05 to 1.0 μm, more preferably from 0.1 to 0.6 μm, and still more preferably from 0.1 to 0.4 μm.

The average particle diameter of the magnetic material is measured by the following method. A transmission electro micrograph of the magnetic powder is taken. In the photograph in 40,000 magnifications, 250 particles with particle diameter of not less than 0.01 μm are optionally selected and Martin diameter (length of the line which projected area is divided into two equal parts in a regular direction) in the projected diameter is measured and this diameter represents by number average particle diameter.

In the toner of the present invention, as an external additive, known materials may be used. In order to improve charge stability, developing performance, fluidity and storage stability, it may preferably be selected from fine inorganic powder such as fine silica powder, fine alumina powder, fine titania powder, and fine powders of double oxides thereof. Fine silica powder is more preferred. Silica includes what is called dry-process silica or fumed silica, produced by vapor phase oxidation of silicon halides or alkoxides, and what is called wet-process silica, produced from alkoxides or water glass, either of which can be used. The dry-process silica is preferred, as having less silanol groups on the surface and the inside of fine silica powder and leaving less production residue such as $Na_2O$ and $SO_3^{2-}$. In the dry-process silica, it is also possible to use, in its production step, another metal halide such as aluminum chloride or titanium chloride together with the silicon halide to give a composite fine powder of silica with another metal oxide. Such powders may also be included.

The inorganic fine powder used in the present invention may have a specific surface area, as measured by the BET method using nitrogen gas absorption, of 30 $m^2/g$ or above, and particularly ranging from 50 to 400 $m^2/g$, where good results can be obtained. The fine silica powder may preferably be contained in the toner in an amount of from 0.1 to 8 parts by weight, more preferably from 0.5 to 5 parts by weight, and still more preferably from more than 1.0 to 3.0 parts by weight, based on 100 parts by weight of the toner particles.

For the purposes of making hydrophobic and controlling chargeability, the inorganic fine powder used in the present invention may preferably be treated, if necessary, with a treating agent such as silicone varnish, silicone oil, modified silicone oil of various types, a silane coupling agent, a silane coupling agent having a functional group, other organic silicon compound or an organic titanium compound. The treating agent may be used alone or in combination.

The BET specific surface area is determined by the BET method, where nitrogen is adsorbed on sample surfaces using a specific surface area measuring device AUTOSOBE 1 (manufactured by Yuasa Ionics Co.), and the specific surface area is calculated by the BET multiple point method.

To keep a stable storability of the toner, a fine inorganic powder is preferably treated at least with a silicone oil.

As required, the external additive other than a fine silica powder may be added to the magnetic toner of the invention. For example, used are fine resin particles or fine inorganic particles which serve as an electrification assistant, an electroconductive agent, a flowability applying agent, a caking preventive, a die release agent at the time of thermal roll fixing, a lubricant or an abrasive.

Fine resin particles preferably have an average particle diameter of 0.03 to 1.0 μm. Examples of a polymerizable monomer constituting the fine resin particles include styrene monomers such as styrene, o-methyl styrene, m-methyl styrene, p-methyl styrene, p-methoxy styrene and p-ethyl styrene; acrylic acid monomers; methacrylic acid monomers; ester acrylate monomers such as methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate and phenyl acrylate; ester methacrylate monomers such as methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate and diethyl aminoethyl methacrylate; and other monomers such as acrylonitrile, methacrylonitrile and acrylamide.

As a polymerization method available is suspension polymerization, emulsion polymerization, soap-free polymerization or the like. Preferably, particles are obtained through the soap-free polymerization.

The average particle diameter of the fine particles of the binder resin is measured by the following method. 0.02 g of a sample is placed in screw tube for 5 ml, 3 ml of ethanol is added and the mixture is dispersed by ultrasonic cleaning machine. The sample dispersed is placed on a sample stand of scanning electro microscope and is made uniformly to evaporate ethanol. After spattering the sample stand, it sets in the scanning electro microscope and two photographs are taken at 20,000 magnifications in the same visual field. One photograph is used for measuring average particle diameter and another one is a reserve. Four straight lines comprising diagonals and crosses are drawn on the photograph to be measured, 50 fine particles which is clear in the surface and is easily measured are selected along the straight line. The selected particles are measured to 0.01 μm by using caliper connected to computer to determine average particle diameter.

The aforementioned fine resin particles provide a considerable effect especially when they are used in an image forming method comprising a contact electrification process in which a roller, a brush or another primary electrification device or a blade or another contact electrification member is brought in contact with a surface of a photosensitive drum as an electrostatic latent image holding member for primary electrification. It is also confirmed that the photosensitive drum is effectively prevented from being fused.

Examples of external additive fine particles include, for example, lubricants such as Teflon, zinc stearate and polyvinylidene fluoride (above all polyvinylidene fluoride is preferable); abrasives such as cerium oxide, silicon carbide and strontium titanate (above all strontium titanate is preferable); flowability applying agents such as titanium oxide and aluminum oxide (above all hydrophobic agent is preferable); caking preventives; conductivity applying agents such as carbon black, zinc oxide, antimony oxide and tin oxide; and development property improvers such as white and black fine particles with a reverse polarity.

For the toner of the invention, a charge controlling agent may also be blended (internal applied) or mixed (external applied) with toner particles as needed. An optimum charge quantity can be controlled in accordance with a development system by the charge controlling agent. Especially in the invention, a balance can further be stabilized between the particle size distribution and the charge quantity.

As substances for controlling the toner into a negative charge state, for example, organic metal complexes and chelate compounds are effective, and examples of such substances include monoazo metal complexes, acetylacetone metal complexes, aromatic hydroxycarboxylic acids and aromatic dicarboxylic metal complexes. In addition, other examples of such substances include aromatic hydroxycarboxylic acids, aromatic monocarboxylic acids, aromatic polycarboxylic acids, metallic salts of these substances, anhydrides thereof, esters thereof, and phenol derivatives such as bisphenols.

As a substance to be controlled positive charge, the substance may include Nigrosine and its products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these; triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more.

The charge controlling agent is preferably used as fine particles. In this case, the number average particle diameter of the charge controlling agent is 4 μm or less, preferably 3 μm or less. In the case of the internal application of the charge controlling agent to the toner, 0.1 to 20 parts by weight, preferably 0.2 to 10 parts by weight of the agent are used relative to 100 parts by weight of the binder resin.

With regard to number average particle diameter of the charge controlling fine particle, the particles with particle diameter of not less than 0.1 μm are measured by using laser diffraction particle size distribution meter in the following manner.

Measuring method:

0.005 g of a sample (a microspaturaful of the sample) is placed in beaker for 100 ml, about 30 ml of exchanged water is added, two to three drops of noionic surfactant is added and the mixture is dispersed for 3 minutes by ultrasonic dispersion machine (USW). The dispersion state is observed. In a case when cogulations are observed, two drops of dry well are added and the mixture is further dispersed for 2 minutes by USW.

Surfactant (drainage liquid for photographic paper): Dry well original liquid (product by FUJI Shashin Film Co. containing 200 ml)

Measuring machine and Measuring condition:

SK LASER MICRON SIZER: SEISHIN KIGYO Model PRO-7000S

Ultrasonic dispersion machine (ultrasonic cleaning apparatus): TAKEDARIKA AU-10C Type In a generally preferable method for preparing the toner, for example, a binder resin; a pigment, a dye or a magnetic substance as a colorant; and a wax, a metallic salt, a metal complex, a charge controlling agent or another additive as needed are sufficiently mixed in a Henschel mixer, a ball mill or another mixer. Thereafter, by using a heating roll, a kneader, an extruder or another thermal kneader, melting/kneading is performed. To fused resins dispersed or dissolved are the colorant, metal compounds as needed, the pigment and the dye. After cooling/solidifying and grinding, classification and surface treatment are performed as needed to obtain toner particles. A fine inorganic powder or the like is applied or mixed as needed.

To achieve a specific circularity distribution and a specific particle size distribution of the toner according to the invention, in some case the particles are only ground (further classified as needed) by using a mechanical impact grinder, a jet grinder or another known grinder. In order to obtain a sharp circularity distribution, however, preferably in the grinding process, heat is applied or a mechanical impact is applied in an auxiliary manner.

The pulverized (further classified as needed) toner particles may be dispersed into hot water in a hot water bath or passed through hot air current. In this case, however, the electrification quantity of the toner is lowered. Considering from transferability and other image characteristics and further from productivity, the method in which additionally a mechanical impact force is applied is most preferable.

Figure 13:
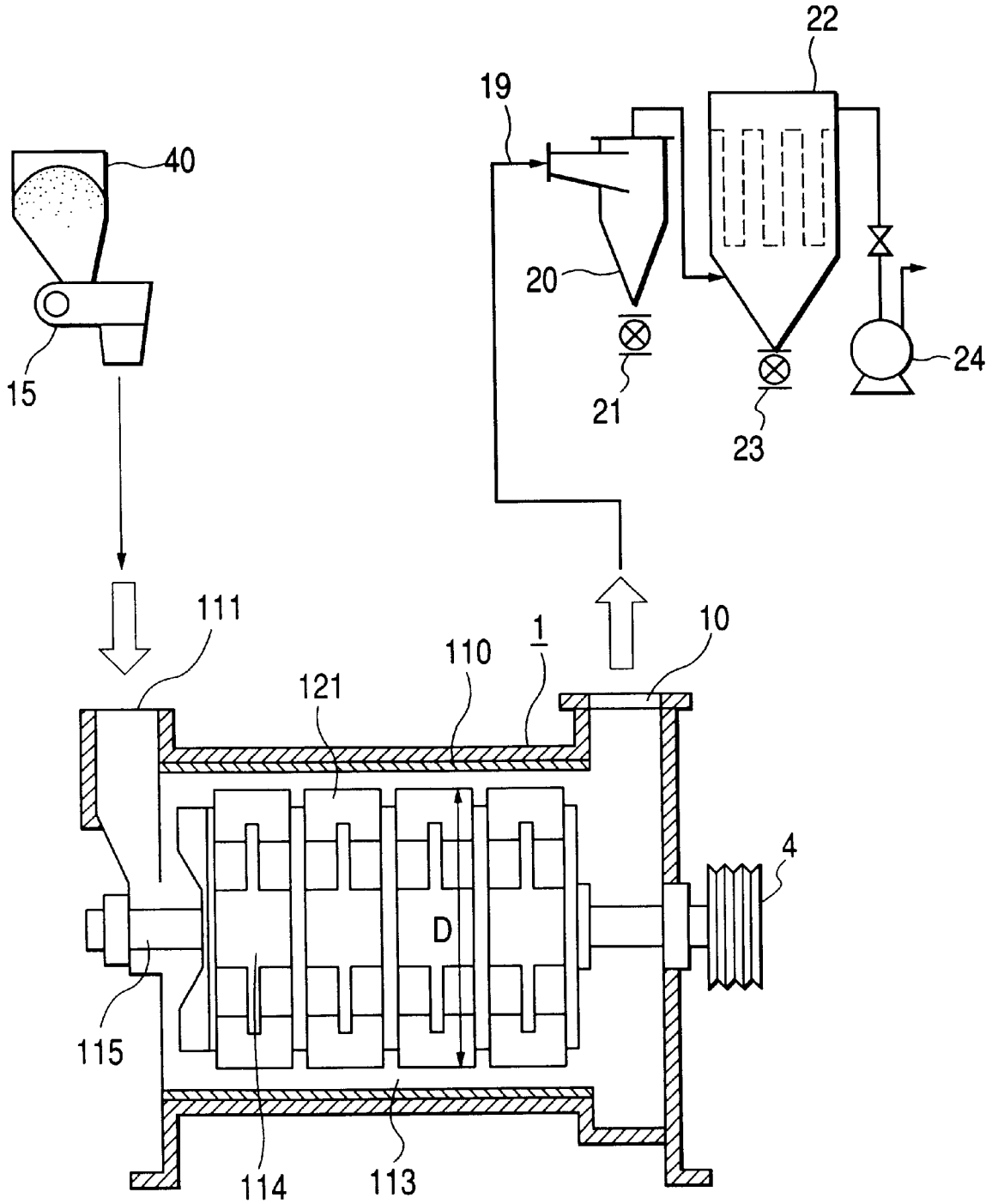
FIG. 13 is a diagram showing an example of a mechanical grinding device.

As a means for applying the mechanical impact force, for example, Cryptron system manufactured by Kawasaki Juko K. K., a turbo mill manufactured by Turbo Kogyo K. K. or another mechanical impact grinder is used. Alternatively, by using Mechano-fusion system manufactured by Hosokawa Micron K. K. or a hybridization system manufactured by Nara Kikai Seisakusho, the toner is pressed onto an inner face of a casing by means of a centrifugal force of a blade which rotates at a high speed, so that the mechanical impact force is applied to the toner by a compressive/frictional force. Specifically, to obtain the toner of the invention, the mechanical impact grinder, for example, the turbo mill manufactured by Turbo Kogyo K. K. is used as shown in FIG. 13. In an atmosphere at a temperature of 35° C or more, while a speed of a blade 121 is in the range of from about 60 m/sec. to 150 m/sec., a rotor 114 is rotated to pulverize the toner, while the circularity distribution and the particle size distribution are adjusted. Additionally, surface treatment may be performed with the mechanical impact force.

The process of applying the mechanical impact force is performed after the process of pulverizing the toner or after the classification process, which is especially preferable in that trailing is suppressed, the storability of the toner is improved and transferability is enhanced.

As constitution of a mechanical impact pulverizer as shown in the cross-sectional view of FIG. 13, surface modifying apparatus I having a system to provide mechanical impact force is used. The apparatus comprising treating chamber 1 with 4 steps of rotors 114 to be vertically rotate which are provided around rotating shaft 115 extended to a horizontal direction as shown in FIG. 13 and which comprises 4 treating blades 121 provided horizontally on disc in a horizontal direction. As the concrete surface modification, each of rotors 114 is rotated at peripheral speed of 40 m/s by driving driving motor 4, cyclone 20 and blower 24 are provided on outlet side of the surface modifying apparatus I, and toners in toner container 40 are supplied from toner supplying inlet on upper of the treating apparatus through supply inlet 111 at the rate of 20 kg/hour by autofeeder 15 in a suction state at blower rate of 3.0 $m^2$ to surface treat magnetic toner. The magnetic toner introduced into treating chamber 1 in the surface modifying apparatus receives impact force by passing it through a very small gap between rotating treating blade 121 and an inner wall of treating chamber 1 to be spherical-treated. The toner surface-treated passes through from outlet 10 to inlet 19 of the cyclone and then is collected by rotary valve 21. A bug fine powder of the toner passes through bug filter 22 to be collected by rotary valve 23.

Figure 11:
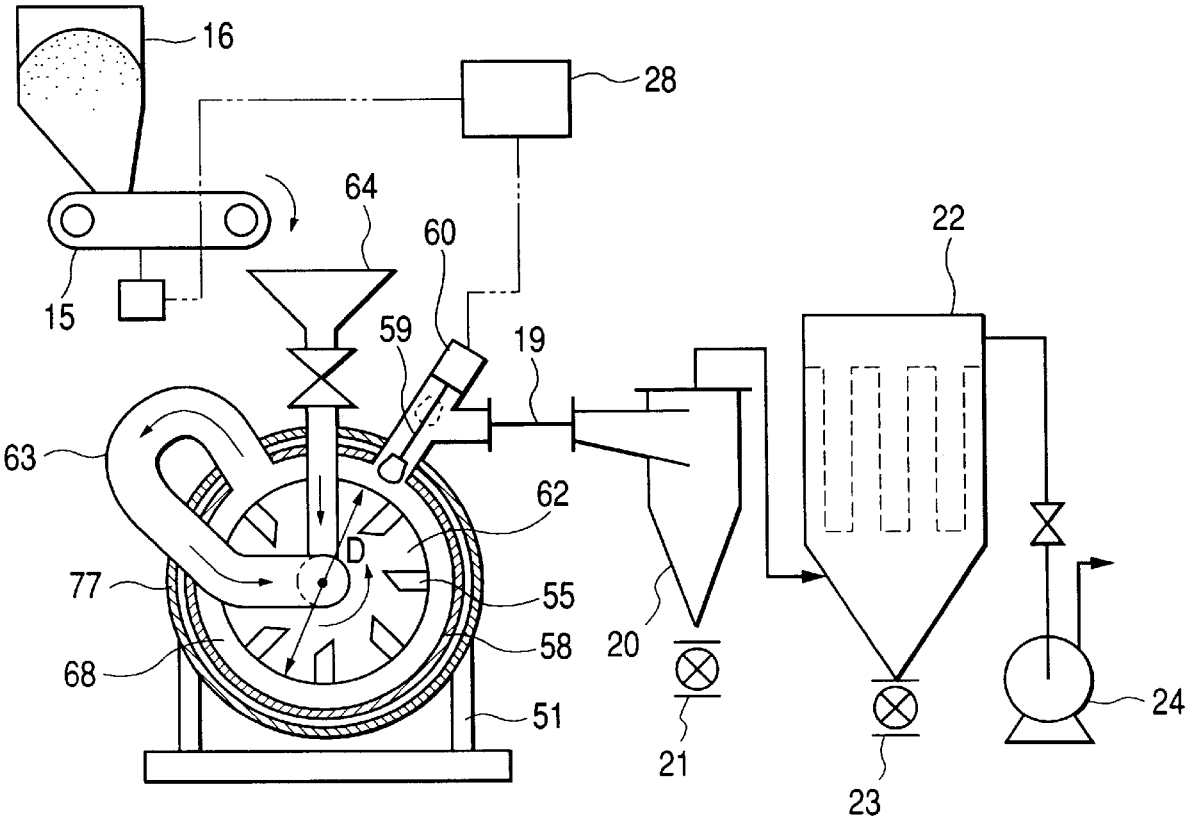
FIG. 11 is a diagram showing an example of a process device system.
Figure 12:
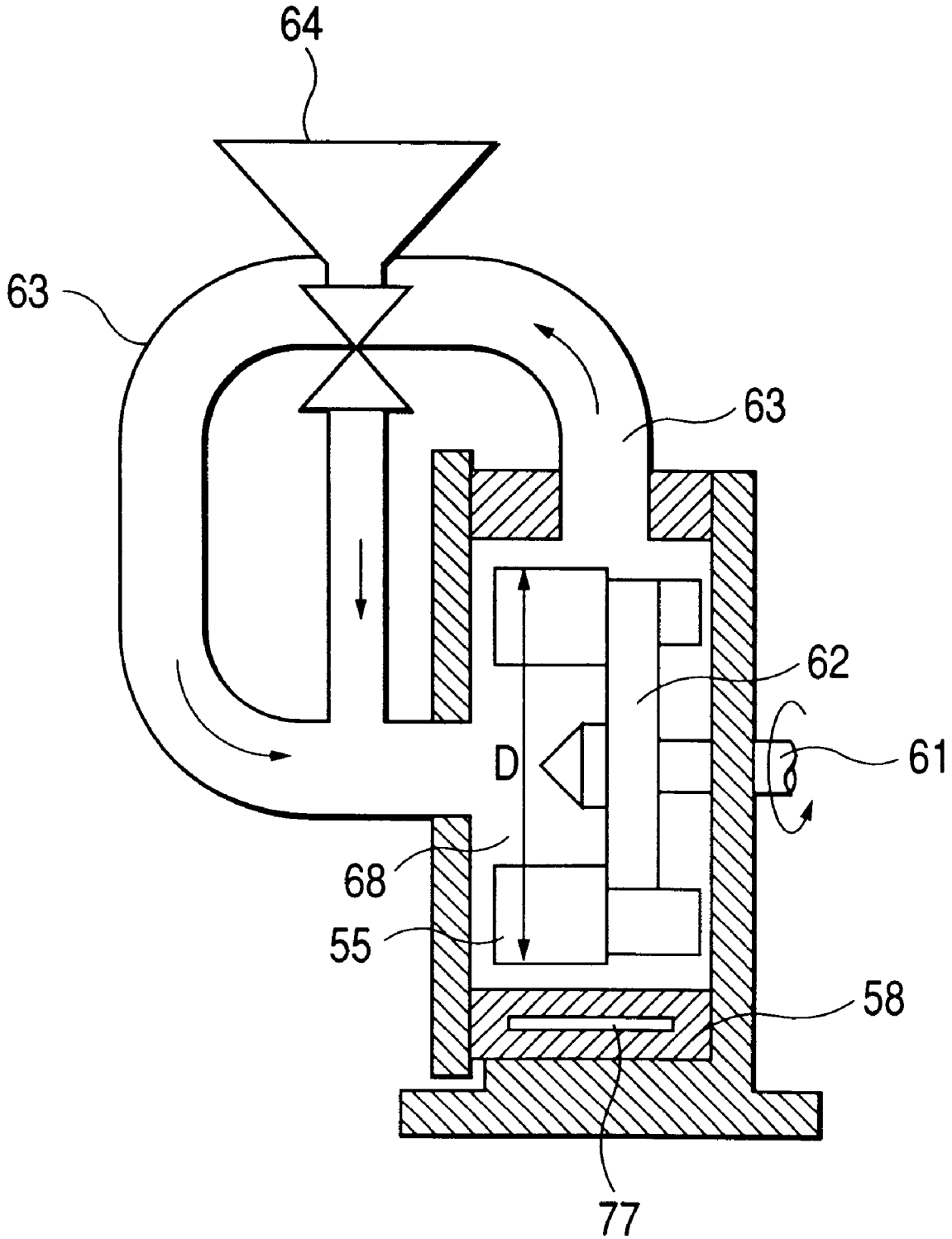
FIG. 12 is a diagrammatic section al view of a surface treatment device in FIG. 11.

In an impact surface treatment device, as shown in FIGS. 11 and 12, a rotation axis 61 is operated by a drive means. A rotating disc 62 is rotated at a speed which is determined in accordance with the property of the substance whose surface is to be treated in such a manner that the particles are prevented from being cracked. A swift air current generated by rotation of the rotating disc 62 causes a circulating current which passes through a circulating path 63 opened to an impact chamber 68 and returns to a center portion of the rotating disc 62.

Subsequently, a fixed quantity of powder to be treated is thrown via a raw-material hopper 64 into the impact chamber 68. The thrown powder to be treated is momentarily subjected to an impact by the disc 62 rotating at a high speed. Further, the powder is thrust into a collision ring 58 disposed around the disc 62 to be further subjected to impacting action. Thereafter, the powder is returned via the circulating path 63 back to the impact chamber 68 by means of the circulating current to be again subjected to impacting action and surface treatment. The rotating disc 62 is preferably rotated in such a manner that the speed of blades 55 is in the range of from 60 m/sec to 150 m/sec.

Either one of the classification process and the surface treatment process may precede the other. In the classification process, a multi-divisional classifier is preferably used to enhance a production efficiency.

A preferred specific example of the image forming process and the heat fixing method of the present invention will be described with reference to FIG. 14.

The surface of a photosensitive drum (a latent image bearing member) 153 comprising an OPC (organic photoconductive material) is negatively charged by a primary corona assembly 161 serving as a contact charging member comprising a charging roller, and exposed to laser light 155 to form a digital latent image by image scanning. The latent image thus formed is reverse developed using a triboelectrically negatively chargeable magnetic toner 163 which is held in a developing assembly 151 serving as a developing means, having an elastic blade 158 made of urethane rubber provided in the counter direction and a developing sleeve 156 internally provided with a magnet 165. Alternatively, using an amorphous silicone photosensitive member, the amorphous silicon photosensitive member is positively charged to form an electrostatic latent image, and the latent image is regularly developed using a triboelectrically negatively chargeable magnetic toner. In the developing zone, an AC bias, a pulse bias and/or a DC bias is/are applied to the developing sleeve 156 through a bias applying means 162. A transfer medium P as a recording medium is delivered to the transfer zone, where the transfer medium P is electrostatically charged on its back surface (the surface opposite to the photosensitive drum) through a contact transfer member 154 comprising a transfer roller, serving as transfer means, so that a toner image formed on the surface of the photosensitive drum is electrostatically transferred to the transfer medium P. The transfer medium P separated from the photosensitive drum 153 is subjected to fixing using a heat-pressure fixing assembly having a fixing roller 171 internally provided with a heating means 170 and having a pressure roller 172 to be contacted with the fixing roller 171, in order to fix the toner image held on the transfer medium P by passing through the contact portion between the fixing roller 171 and the pressure roller 172.

The magnetic toner remaining on the photosensitive drum 153 after the transfer step is removed by the operation of a cleaning means 164 having a cleaning blade 157. After the cleaning, the the surface of the photosensitive drum 153 is destaticized by erase exposure 160, and thus the procedure again starting from the charging step using the primary corona assembly 161 is repeated.

The electrostatic latent image bearing member (photosensitive drum) comprises a photosensitive layer and a conductive substrate, and is rotated in the direction of an arrow. In the developing zone, the developing sleeve 156, formed of a non-magnetic cylinder, which is a developer carrying member, is rotated so as to move in the same direction as the direction in which the electrostatic latent image bearing member is rotated. Inside the non-magnetic cylinder, developing sleeve 156, a multi-polar permanent magnet 165 (magnet roll) serving as a magnetic field generating means is provided in an unrotatable state. The magnetic toner 163 held in the developing assembly 151 is coated on the surface of the non-magnetic cylinder, and negative triboelectric charges are imparted to the magnetic toner particles because of the friction between the surface of the developing sleeve 156 and the magnetic toner particles. An elastic doctor blade 158 is also disposed, whereby the thickness of developer layer is controlled to be small (30 $\mu$m to 300 $\mu$m) and uniform so that a toner layer smaller in thickness than the gap between the photosensitive drum 153 and the developing sleeve 156 in the developing zone is formed in a non-contact state. The rotational speed of this developing sleeve 156 is regulated so that the peripheral speed of the sleeve can be substantially equal or close to the speed of the peripheral speed of the electrostatic latent image bearing member.

An AC bias or a pulse bias may be applied to the developing sleeve 156 through a bias means 162. This AC bias may have a frequency (f) of from 200 to 4,000 Hz and a Vpp of from 500 to 3,000 V.

When the magnetic toner particles are moved in the developing zone, the magnetic toner particles move to the side of the electrostatic latent image by the electrostatic force of the surface of the photosensitive drum 153 holding the electrostatic latent image and the action of the AC bias or pulse bias.

The developing sleeve 156 as mentioned above may have any desired structure. For example, it is constituted of a non-magnetic developing sleeve 156 internally provided with a magnet 165. The developing sleeve 156 may be a cylindrical rotary member as shown in FIG. 14, or may be a belt-like member that is circulatingly movable. As a material therefor, usually it is preferable to use aluminum or SUS.

The elastic blade 158 as mentioned above may be constituted of an elastic plate formed of a rubber elastic material such as urethane rubber, silicone rubber or NBR; a metal elastic material such as phosphor bronze or stainless steel sheet; or a resin elastic material such as polyethylene terephthalate or high-density polyethylene. The elastic blade 158 is brought into touch with the developing sleeve 156 by its own elasticity, and is secured to the toner container 152 through a blade support member 159 formed of a rigid material such as iron. The elastic blade 158 may preferably be brought into touch with the developing sleeve 156 at a linear pressure of from 5 to 80 g/cm in the counter direction with respect to the rotational direction of the developing sleeve 156.

Instead of the elastic blade 158, a magnetic doctor blade constituted of, e.g., iron may be used.

For the primary charging means, the charging roller 161 has been described as the contact charging means. A charging blade, a charging brush or another contact charging means may be used. Further, a non-contact corona charging means may be used. However, the contact charging means is preferable because less ozone is generated through the charging. For the transfer means, the transfer roller 154 has been described. A transfer blade or another contact transfer means may be used. Further, a non-contact corona transfer means may be used. However, the contact transfer means is preferable because less ozone is generated through the transfer.

Figure 14:
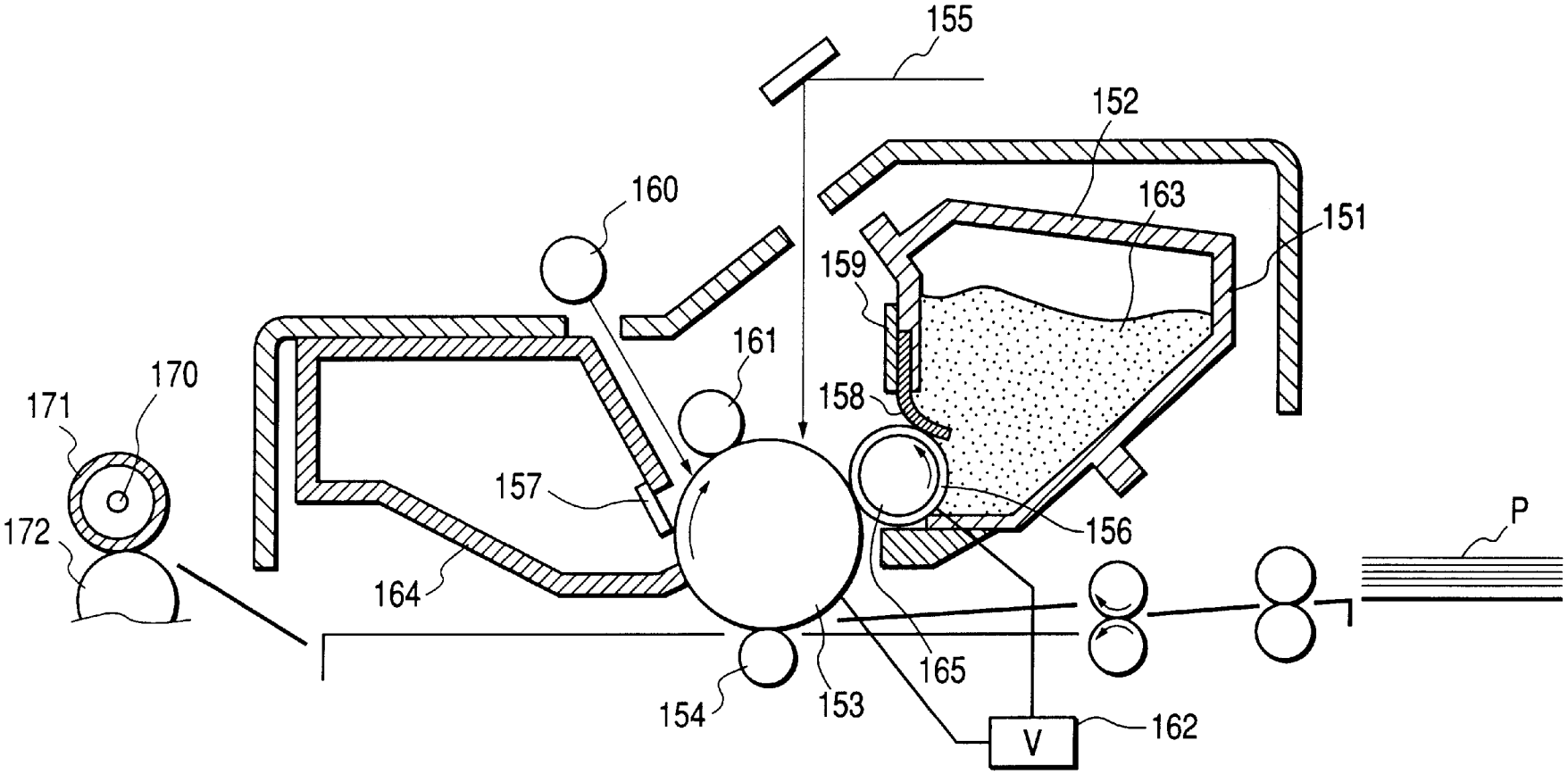
FIG. 14 is a schematic diagram of an image forming device in which an image forming method of the invention can be implemented.
Figure 17:
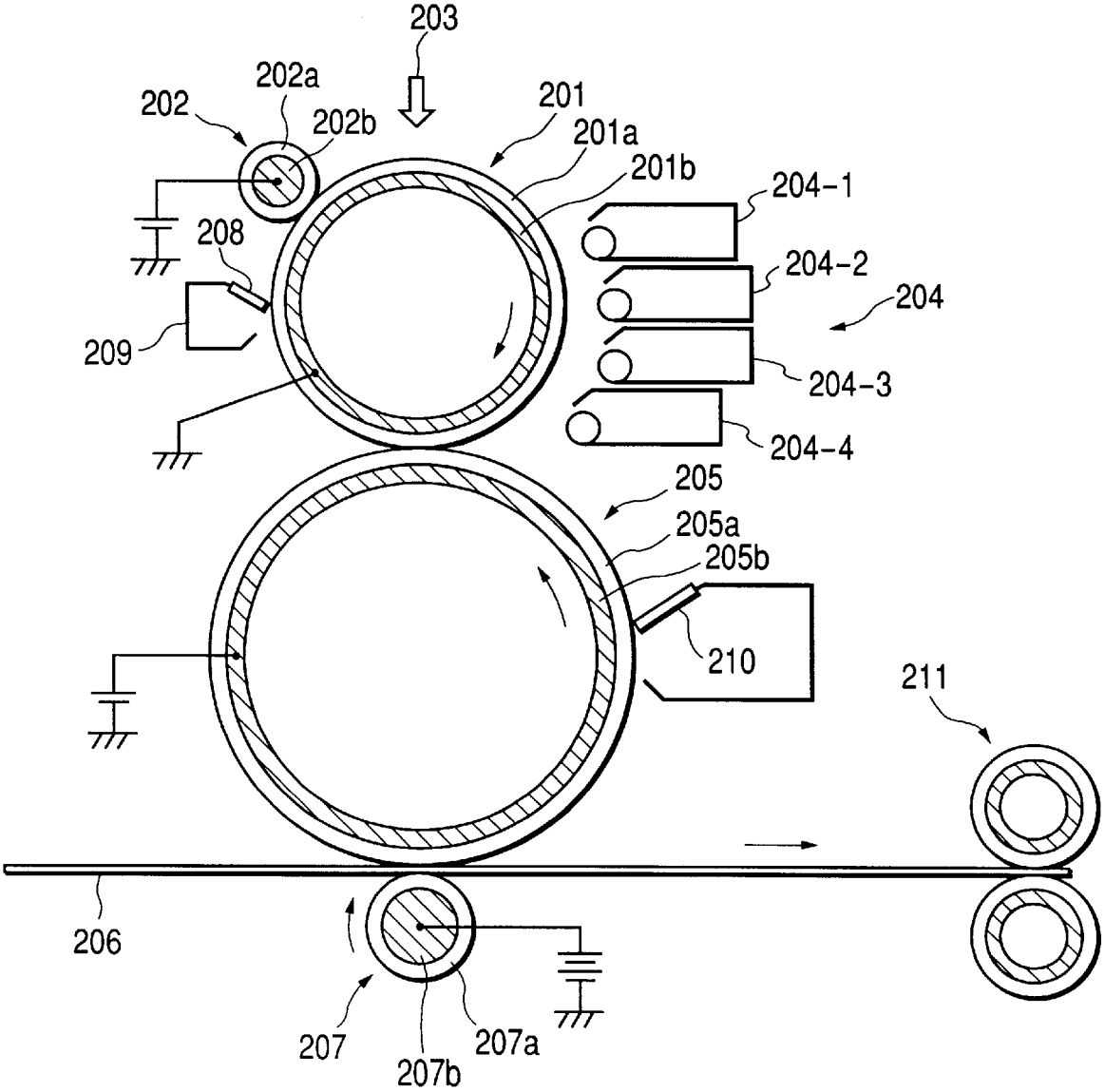
FIG. 17 is a schematic diagram of another image forming device in which the image forming method of the invention can be implemented.

Instead of the image forming apparatus as shown in FIG. 14, it is possible to employ an image forming apparatus comprising an intermediate transfer member as shown in FIG. 17. FIG. 17 illustrates an image forming apparatus of the type wherein toner images on the electrostatic latent image bearing member are primarily transferred to an intermediate transfer member and thereafter the toner images on the intermediate transfer member are secondarily transferred to the recording medium.

A photosensitive member 201 comprises a substrate 201*a* and provided thereon a photosensitive layer 201*b* having an organic photo-semiconductor, and is rotated in the direction of an arrow. By means of a charging roller 202 (a conductive elastic layer 202*a* and a mandrel 202*b*), the surface of the photosensitive member 201 is electrostatically charged to have a surface potential of about −600 V. Exposure is carried out using a polygon mirror by on-off control on the photosensitive member 201 in accordance with digital image information, whereby an electrostatic latent image with an exposed-area potential of −100 V and a dark-area potential of −600 V. Using a plurality of developing assemblies 204-1, 204-2, 204-3 and 204-4, the magenta toner, cyan toner, yellow toner or black toner is imparted to the surface of the photosensitive member 201 to form toner images by reverse development. The toner images are transferred to an intermediate transfer member 205 (an elastic layer 205*a*, a mandrel 205*b* as a support) for each color to form four color, color-superimposed developed images on the intermediate transfer member 205. The toner remaining on the photosensitive member 201 after transfer is collected in a residual toner container 209 by means of a cleaning member 208.

Since the toner according to the present invention has a high transfer efficiency, problems may hardly occur even in a system having a simple bias roller or having no cleaning member.

The intermediate transfer member 205 is comprised of the pipe-like mandrel 205*b* and the elastic layer 205*a* provided thereon by coating, formed of nitrile-butadiene rubber (NBR) in which carbon black as the conductivity-providing agent has been well dispersed. The coat layer thus formed has a hardness according to JIS K-6301, of 30 degrees and a volume resistivity of $10^9$ Ω.cm. Transfer electric current necessary for the transfer from the photosensitive member 201 to the intermediate transfer member 205 is about 5 μA, which can be obtained by applying a voltage of +2,000 V to the mandrel 205*b* from a power source. After the toner images have been transferred from the intermediate transfer member 205 to the transfer medium 206, the surface of the intermediate transfer member may be cleaned by means of a cleaning member 210.

The transfer roller 207 is formed by coating on a mandrel 207*b* of 20 mm diameter a foamable material of an ethylene-propylene-diene terpolymer (EPDM) in which carbon black conductivity-providing agent has been well dispersed. A transfer roller whose elastic layer 207*a* thus formed shows a volume resistivity of $10^6$ Ω.cm and a hardness according to JIS K-6301, of 35 degrees is used. A voltage is applied to the transfer roller to flow a transfer current of 15 μA. With regard to the toner remaining as a contaminant on the transfer roller 207 when the toner images are one-time transferred from the intermediate transfer member 205 to the transfer medium 206, it is common to use a fur brush cleaner as a cleaning member or to use a cleanerless system.

In the present invention, any one of the developing assemblies 204-1, 204-2, 204-3 and 204-4 is set up by a magnetic one-component jumping development system making use of a magnetic toner, and the developing assembly constructed as shown in FIG. 14 is used. As other three developing assemblies for non-magnetic color toners, developing assemblies for two-component magnetic brush development or developing assemblies for non-magnetic one-component development are used.

Figure 15:
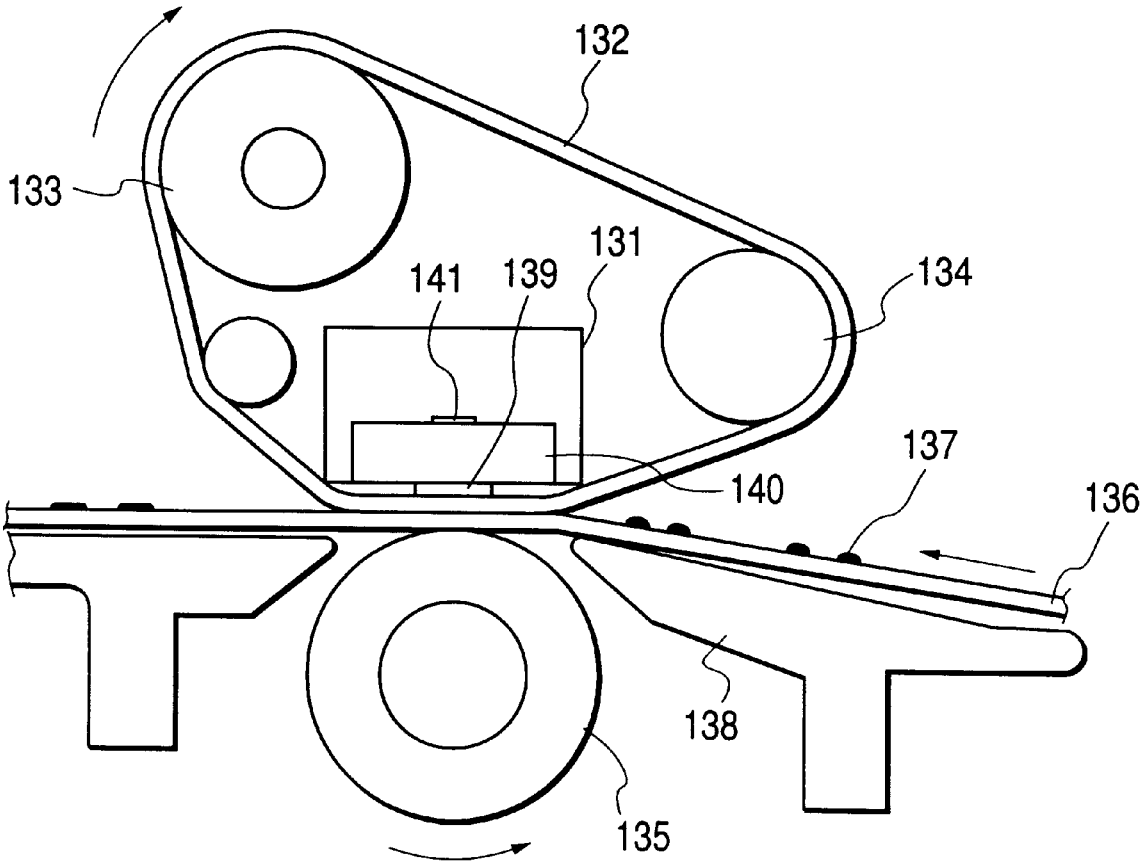
FIG. 15 is a schematic diagram showing a constitution of a heat transfer device in which a heat transfer method of the invention can be implemented.

In the image forming method and the heat-fixing method according to the invention, instead of the heat-fixing device provided with the fixing roller 171 and the pressure roller 172 shown in FIG. 14, a heat-fixing device constituted of a fixing film shown in FIG. 15 may be used.

The heat-fixing device shown in FIG. 15 is provided with a fixing film 132 for contacting with a toner image on a recording material 136, a heating member 131 for heating the fixing film 132 and a pressure roller 135 for pressing onto the fixing film 132 a face of the recording material 136 on which the toner image is formed.

In the fixing device shown in FIG. 15, the heater element 131 has a smaller heat capacity than conventional heat rolls, and has a linear heating part. The heating part may preferably be made to have a maximum temperature of from 100° C. to 300° C.

The fixing film 132 interposed between the heater element 131 and the pressure roller 135 as the pressure member may preferably comprise a heat-resistant sheet of from 1 to 100 μm thick. Heat-resistant sheets used therefor may include sheets of polymers having high heat-resistance, such as polyester, PET (polyethylene terephthalate), PFA (a tetrafluoroethylene-perfluoroalkyl vinyl ether copolymer), PTFE (polytetrafluoroethylene), polyimide and polyamide, sheets of metals such as aluminum, and laminate sheets comprised of a metal sheet and a polymer sheet.

In a preferred constitution of the fixing film, these heat-resistant sheets have a release layer and/or a low-resistance layer.

A specific example of the fixing device will be described with reference to FIG. 15.

Reference numeral 131 denotes a low heat capacitance linear heater element stationarily supported in the fixing device. An example thereof comprises an alumina substrate 140 of 1.0 mm thick, 10 mm wide and 240 mm in longitudinal length and a resistance material 139 coated thereon to have a width of 1.0 mm, which is electrified from the both ends in the longitudinal direction. The electricity is applied under variations of pulse widths of the pulses corresponding with the desired temperatures and energy emission quantities which are controlled by a temperature sensor 141, in the pulse-like waveform with a period of 20 msec of DC 100V. The pulse widths range approximately from 0.5 msec to 5 msec. In contact with the heater element 131 the energy and temperature of which have been controlled in this way, a fixing film 132 moves in the direction of an arrow shown in the drawing.

An example of this fixing film includes an endless film comprised of a heat-resistant film of 20 μm thick (comprising, for example, polyimide, polyether imide, PES, or PFA) and a release layer comprising a fluorine resin such as PTFE or PFA to which a conductive material is added, coated at least on the side coming into contact with the image to have a thickness of 10 μm. In general, the total thickness of the film may preferably be less than 100 μm, and more preferably less than 40 μm. The film is moved in the direction of the arrow in a wrinkle-free state by the action of the drive of, and tension between, a drive roller 133 and a follower roller 134.

Reference numeral 135 denotes a pressure roller having on its surface an elastic layer of rubber with good release properties as exemplified by silicone rubber. This pressure roller is pressed against the heater element at a total pressure of from 4 to 20 kg through the film interposed between them and is rotated in pressure contact with the film. Toner 137 having not been fixed on a transfer medium 136 is led to the fixing zone by means of an inlet guide 138, and thus a fixed image is thus obtained by the heating described above.

The fixing film 132 has been described above with reference to an embodiment having the endless belt. Alternatively, using a sheet-feeding shaft and a wind-up shaft, the fixing film may not be endless.

In the heat fixing method as described above, the heater element has a hard flat surface and hence, at the fixing nip portion, the transfer medium pressed by the pressure roller is fixed thereon with the toner in a flat state and also the gap between the fixing film and the transfer medium become s narrow on account of its structure, right before the latter thrusts into the gap portion. Hence, the air around the fixing film and transfer medium is brought to be driven out rearwards.

In that state, lines (of toner images) on the transfer medium, formed in parallel in the longitudinal direction of the heater element thrust in, whereupon the air comes to be driven out toward the lines. If in this situation the toner lightly stands on the lines, the air having its escape cut off breaks down the lines to go out rearwards, so that the lines are broken off to cause the phenomenon of toner scatter where toner particles fly rearwards.

Especially when transfer paper as the transfer medium has no smooth surface or has absorbed moisture, the transfer electric field may become weak to weaken the attraction of the toner to the transfer medium, so that the toner particles come to be softly laid on the lines to tend to cause the toner scatter. Also when the fixing speed is high, the wind pressure is so high as to more tend to cause the toner scatter.

However, since the circularity of the toner according to the invention is regulated, the developed toner particles easily become dense. Therefore, the toner particles are laid on the line in a compacted condition. Even when the toner image is fixed in the aforementioned heat-fixing method, the particles can be prevented from scattering. Alternatively, the scattering phenomenon can be reduced.

Further, the toner of the invention has the ratio Mw/Mn of the contained wax between the weight-average molecular weight Mw and the number-average molecular weight Mn in the range of 1.0 to 2.0. Since the toner is readily dissolved, this respect is also effective for preventing the particles from scattering.

The toner of the invention is applied in a magnetic one component development method, a nonmagnetic one component development method or another one component development method and a two component development method in which toner and carrier are used.

Figure 16:
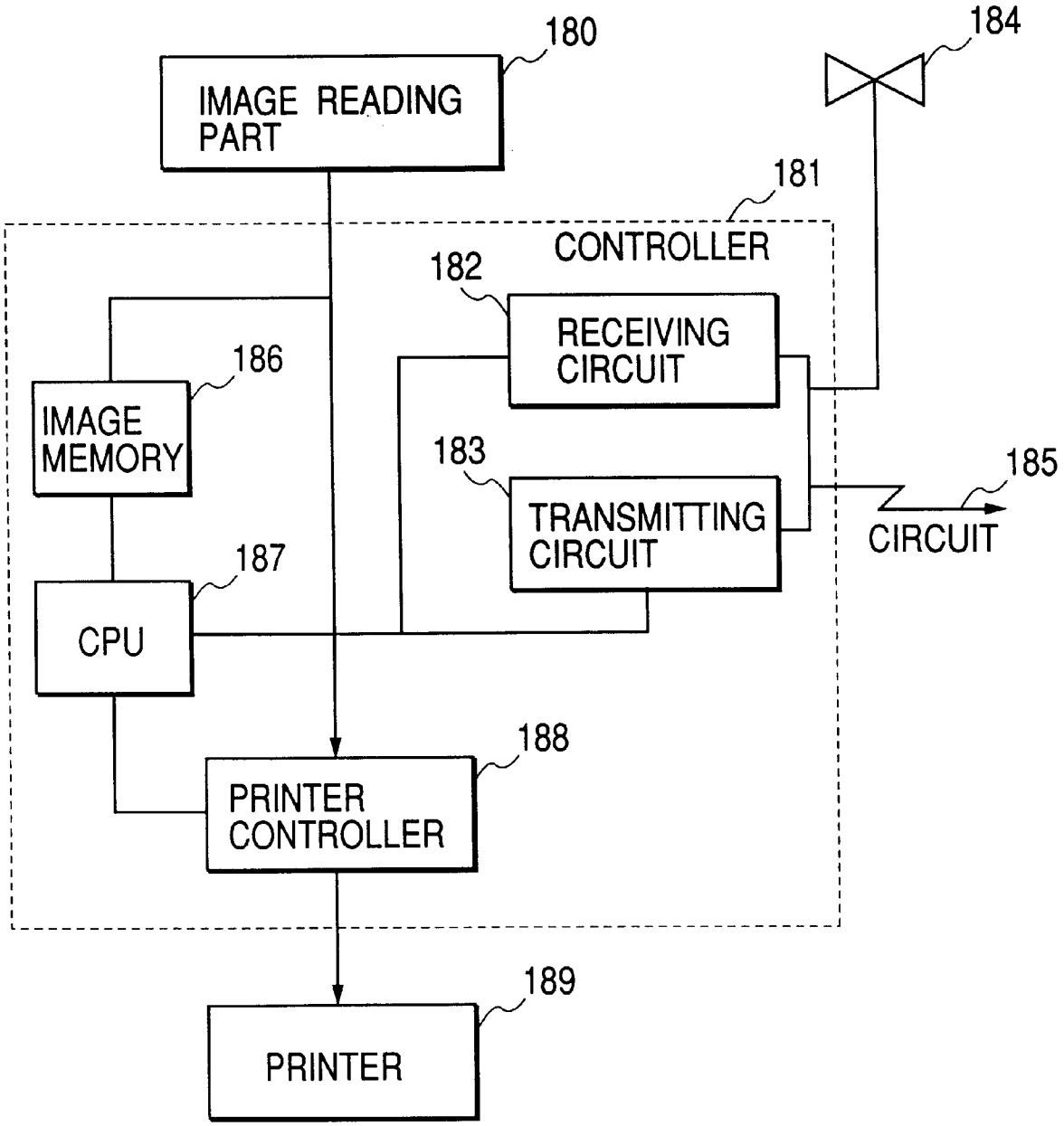
FIG. 16 is a block diagram showing that the image forming method of the invention is applied to a facsimile machine printer.

In the case when the image forming process of the present invention is applied in a printer of a facsimile machine, optical image exposing light L serves as exposing light used for the printing of received data. FIG. 16 illustrates an example thereof in the form of a block diagram.

A controller 181 controls an image reading part 180 and a printer 189. The whole of the controller 181 is controlled by CPU 187. Reading data outputted from the image reading part is sent to the other facsimile station through a transmitting circuit 183. Data received from the other station is sent to a printer 189 through a receiving circuit 182. Given image data are stored in an image memory. A printer controller 188 controls the printer 189. The numeral 184 denotes a telephone.

An image received from a circuit 185 (image information from a remote terminal connected through the circuit) is demodulated in the receiving circuit 182, and then successively stored in an image memory 186 after the image information is decoded by the CPU 187. Then, when images for at least one page have been stored in the memory 186, the image recording for that page is carried out. The CPU 187 reads out the image information for one page from the memory 186 and sends the encoded image information for one page to the printer controller 188. The printer controller 188, having received the image information for one page from the CPU 187, controls the printer 189 so that the image information for one page is recorded.

The CPU 187 receives image information for next page in the course of the recording by the printer 189.

As mentioned above, receiving and recording of the images are carried out.

According to the invention, the toner has a specific circularity distribution and a specific particle size distribution. Therefore, the developed toner particles have a high density. The trailing phenomenon can be suppressed.

Especially when the toner contains the wax having a DSC endothermic peak in a specific temperature region and a specific molecular-weight distribution and the binder resin having a specific molecular-weight distribution in the GPC molecular-weight distribution, then the toner is momentarily soluble at the time of fixing by means of the heat-fixing means. The trailing phenomenon can be suppressed more effectively. The toner is superior in storability at high temperature and humidity.

EXAMPLES

The present invention is described below in more detail with Production Examples and Application Examples without limiting the present invention. In the description below, the term "parts" is based on weight unless otherwise mentioned.

Example 1

| | |
|---|---|
| Styrene-butyl acrylate-maleic acid butyl half ester copolymer (THF-insoluble matter: 0.5%, GPC of THF-soluble matter: peak molecular weight, ca. 43000; proportion of mol. wt. of less than 50000, 50%; proportion of mol. wt. of 50000 to 500000, 42%; proportion of mol. wt. of more than 500000, 8%) | 100 parts |
| Magnetic material (shape: sphere, average particle diameter: 0.20 μm) | 100 parts |
| Monoazo dye-iron complex (average particle diameter: 1.5 μm) | 2 parts |
| Low molecular weight polyethylene (DSC endothermic peak: 106.7° C., Mw/Mn: 1.08) | 4 parts |

The above materials were mixed by a blender, and the mixture was melt-blended by a twin-screw extruder heated to 130° C. The blended mixture, after cooling, was crushed by a hammer mill. The coarse crushed matter was then pulverized into fine particles by a mechanical pulverizer employing a rotor as shown in FIG. 13 at a temperature of 45° C. and at a rotor peripheral speed of 100 m/sec. The resulting fine particles were classified precisely by a multiple classifier utilizing Coanda effect to obtain toner particles. FIG. 10 shows the GPC chromatogram of the THF-soluble portion of the binder resin of the toner particles.

Figure 2:
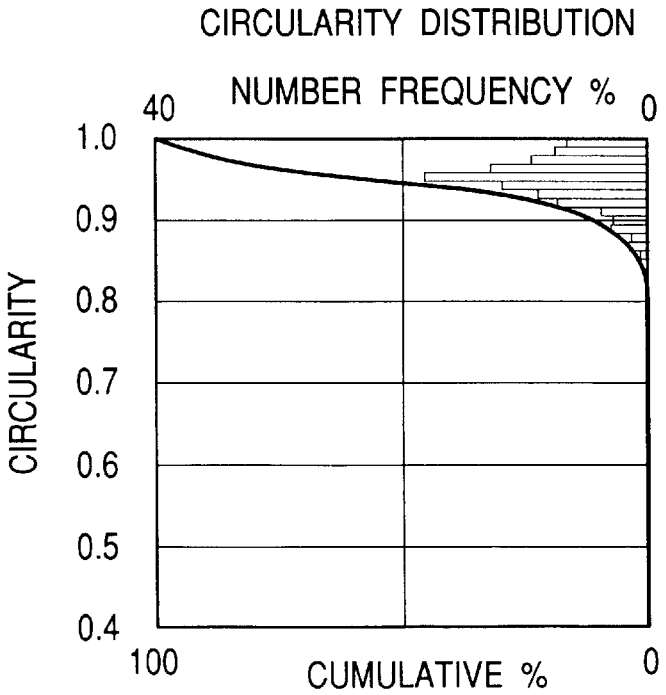
FIG. 2 is a diagram showing a circularity distribution of the toner in the first embodiment.
Figure 3:
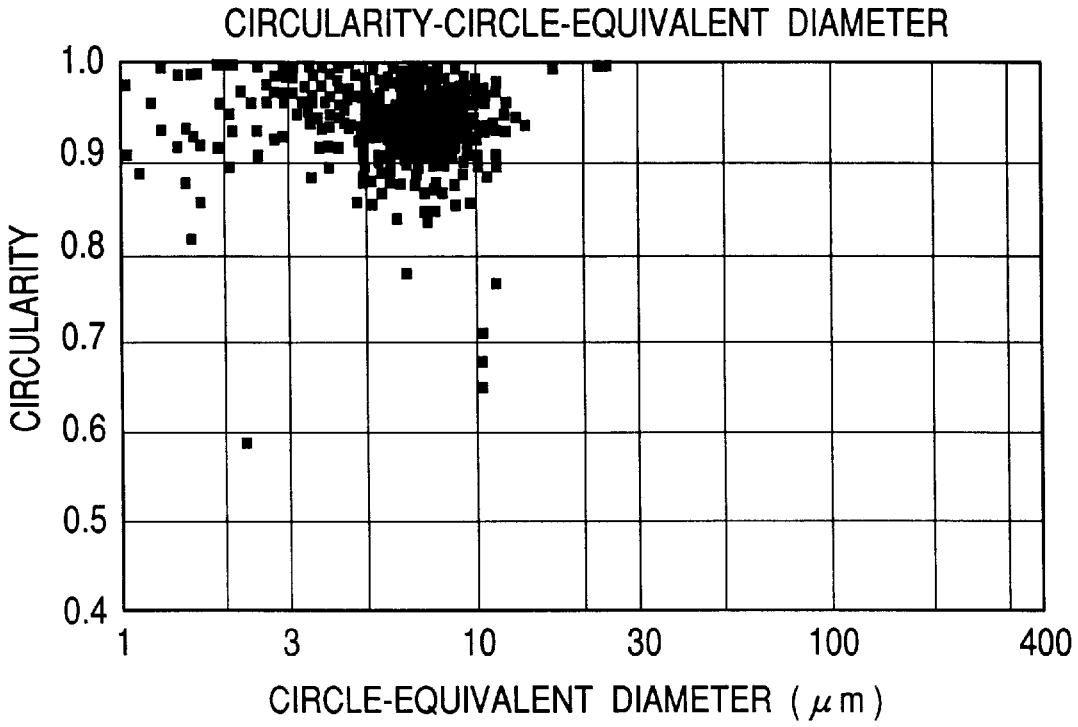
FIG. 3 is a diagram showing the relationship of the particle size distribution and the circularity distribution of the toner in the first embodiment.

To 100 parts of the obtained toner particles, was added 1.2 parts of dry type silica (primary average particle diameter: 0.02 μm) having been treated for hydrophobicity with silicone oil and hexamethyldisilazane, and the mixture was blended by a blender to obtain Toner 1. The resulting toner had a circularity distribution having an average circularity of 0.95, containing particles of a circularity of less than 0.95 at a content of 32.64%, and having a mode circularity of 0.960. The particle size distribution of the obtained toner had a circle-equivalent average diameter of 61 μm, having one peak respectively in the regions of from 0.6 to 3.0 μm and from above 3.0 to 10.0 μm. In the particle size distribution, the particle number frequency in the region of the circle-equivalent diameter of 0.95 to less than 3.00 μm was 8.1%. Table 5 shows the properties of obtained Toner 1. Table 2 shows the particle size frequency data of the obtained toner. FIG. 1 shows the particle size distribution of the toner. FIG. 2 shows the circularity distribution of this toner. FIG. 3 shows the correlation between the circularity and the circle-equivalent diameter of this toner.

Toner 1 was tested for image formation. An unfixed image was formed by an image formation apparatus, LBP-930 (manufactured by Canon K. K., image formation rate of 24 sheets/min of A4-size paper in lateral direction) as shown in FIG. 14. The unfixed image was fixed with a separate fixation device which was a modification of the fixation device of LBP-930 (at a fixation speed of 150 mm/sec at a pressure between the fixation roller and pressing roller of 25 kg-weight). The image was reproduced under environmental conditions of 32.5° C. and 80%RH on a recording paper sheet of a basis weight of 65 g/m$^2$ which had been conditioned before the image formation at 32.5° C. and 80%RH for one day.

As to smeared image trailing edge, the number of trailing on the line is zero and trailing of the print was found to be suppressed sufficiently.

Trailing is examined as below. After printing of 6000 sheets of an image pattern at a print area ratio of 4%, a horizontal line pattern is printed over one sheet at a line width of 4 dots and a line space of 20 dots, and the number of smeared image trailing edges is counted on the line.

The toner could be stored satisfactorily at a high temperature and high humidity. Table 6 shows the results.

The storability of the toner under high temperature and high humidity conditions is evaluated as below. A toner is stored at 40° C. and 95%RH for 30 days. With this toner, after printing of 6000 sheets of image pattern at a printing area ratio of 4%, a solid black image is printed over one sheet. The printed image density is measured by a reflectodensitometer (manufactured by MacBeth Co.). Table 2 shows the results. The printed image density in this Example was 1.50, and was satisfactory.

Example 2

| | |
|---|---|
| Styrene-butyl acrylate-maleic acid butyl half ester copolymer (THF-insoluble matter: 1.5%, GPC of THF-soluble matter: peak molecular weight, ca. 41000; proportion of mol. wt. of less than 50000, 60%; proportion of moi. wt. of 50000 to 500000, 30%; proportion of mol. wt. of more than 500000, 10%) | 100 parts |
| Magnetic material (shape: sphere, average particle diameter: 0.24 μm) | 100 parts |
| Monoazo dye-iron complex (average particle diameter: 1.6 μm) | 2 parts |
| Low molecular weight polyethylene (DSC endothermic peak: 106.7° C., Mw/Mn: 1.08) | 4 parts |

The above materials were mixed by a blender, and the mixture was melt-blended at 90° C. by a twin-screw extruder. The blended mixture, after cooling, was crushed by a hammer mill. The coarse crushed matter was then pulverized into fine particles by a mechanical pulverizer employing a rotor in an atmosphere of 45° C. The resulting fine particles were classified precisely by a multiple classifier utilizing Coanda effect to obtain toner particles.

The toner particles were treated for surface modification by a surface-modifying apparatus of mechanical shock type by rotation of a rotor at 1600 rpm (peripheral speed of 80 m/sec) for 2 minutes with circulation of cooling water at 20° C. to control the inside temperature of the apparatus during the surface modification.

Figure 4:
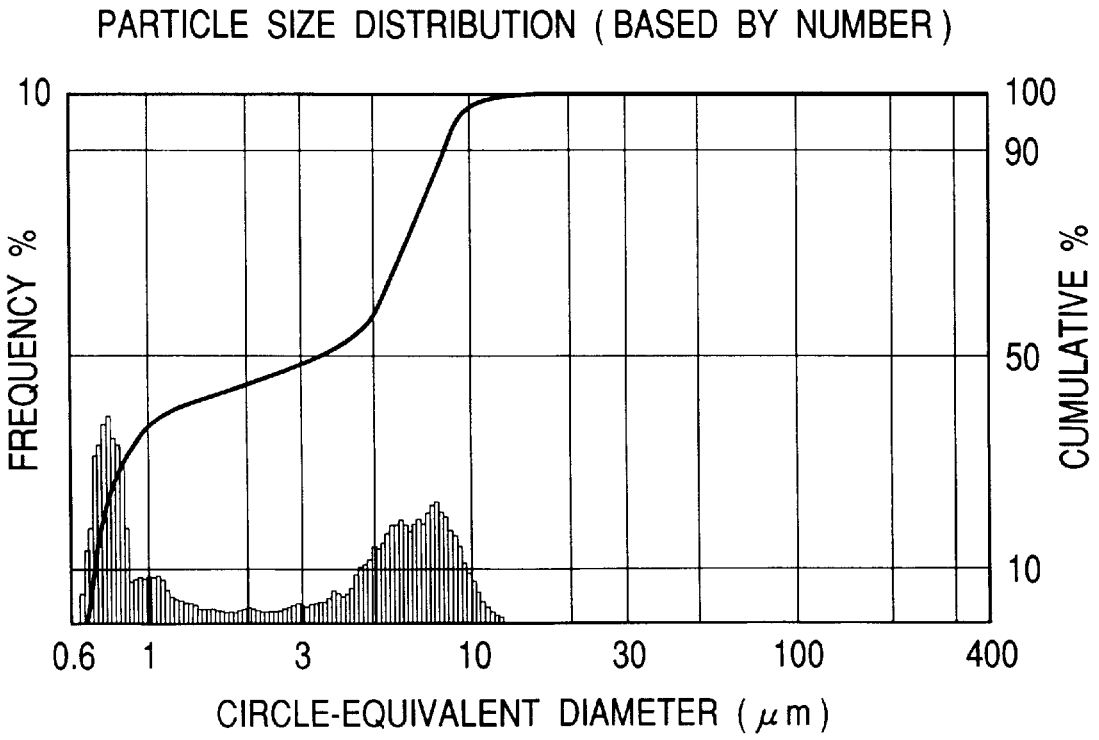
FIG. 4 is a diagram showing a particle size distribution of a toner in a second embodiment.
Figure 5:
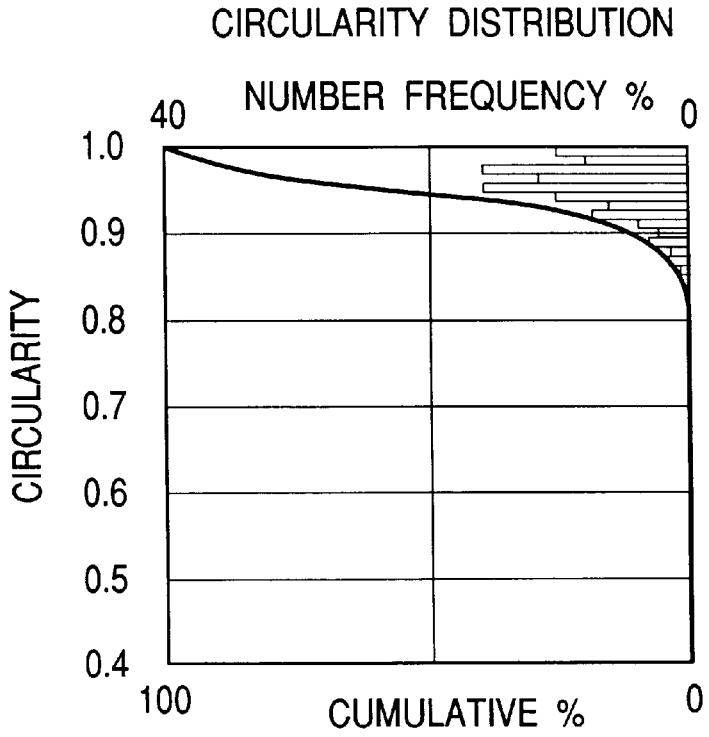
FIG. 5 is a diagram showing a circularity distribution of the toner in the second embodiment.
Figure 6:
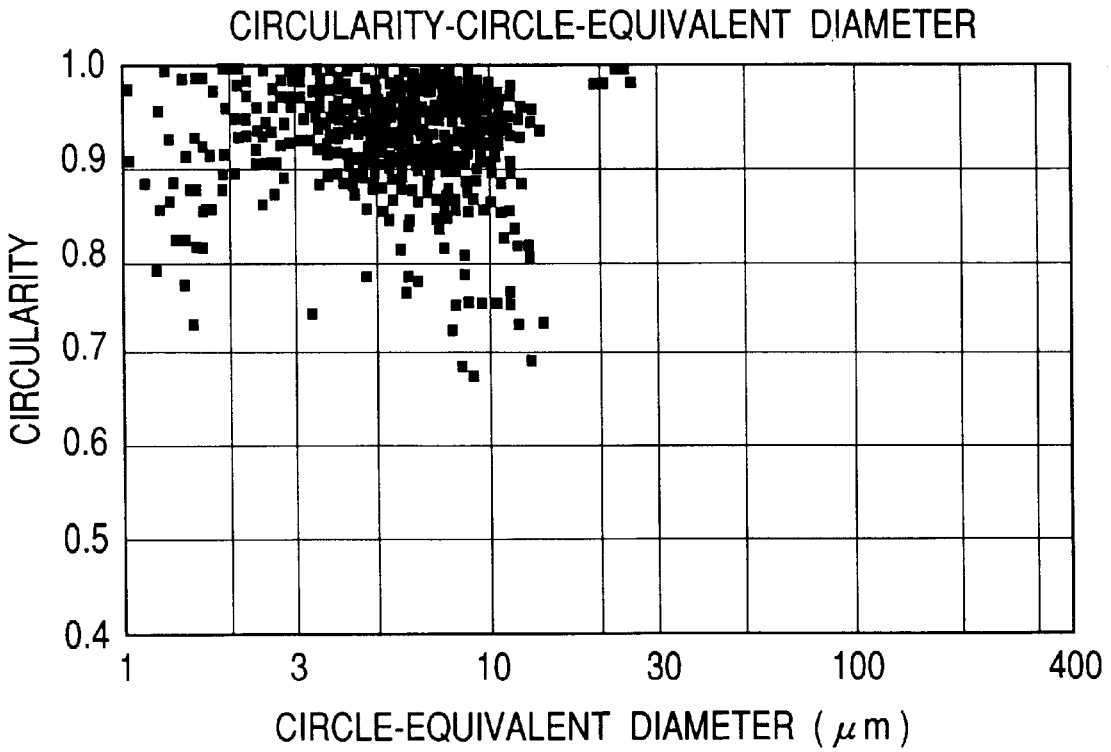
FIG. 6 is a diagram showing the relationship of the particle size distribution and the circularity distribution of the toner in the second embodiment.

To 100 parts of the obtained toner particles, was added 1.2 parts of dry type silica (primary average particle diameter: 0.02 μm) having been treated for hydrophobicity with silicone oil and hexamethyldisilazane, and the mixture was blended by a blender to obtain Toner 2. The resulting toner had a toner circularity distribution having an average circularity of 0.96, containing particles of a circularity of less than 0.95 at a content of 28.7%, and having a mode circularity of 0.98. The particle size distribution of the obtained toner had a circle-equivalent average diameter of 4.0 μm, and one peak respectively in the regions of from 0.6 to 3.0 μm and from more than 3.0 to 10.0 μm. In the particle size distribution, the particle number frequency in the region of the circular-equivalent diameter of 0.95 to less than 3.00 μm was 15.5%. Table 5 shows the properties of obtained Toner 2. Table 3 shows the particle size frequency data of the obtained toner. FIG. 4 shows the particle size distribution of the toner. FIG. 5 shows the circularity distribution of this toner. FIG. 6 shows the correlation between the circularity and the circle-equivalent diameter.

An image was reproduced in the same manner as in Example 1 except that Toner 2 was used as the toner. As the results, the line trailing was suppressed sufficiently with no trailing edge formed on the printed lines. The toner storability was sufficient, and the toner stored at high temperature and high humidity gave a solid black image of a density of 1.52. Table 6 shows the results.

Example 3

| | |
|---|---|
| Styrene-butyl acrylate-maleic acid butyl half ester copolymer (THF-insoluble matter: 1.5%, GPC of THF-soluble matter: peak molecular weight, ca. 45000; proportion of mol. wt. of less than 50000, 55%; proportion of mol. wt. of 50000 to 500000, 35%; proportion of mol. wt. of more than 500000, 10%) | 100 parts |
| Magnetic material (shape: sphere, average particle diameter: 0.21 μm) | 100 parts |
| Monoazo dye-iron complex (average particle diameter: 1.4 μm) | 2 parts |
| Low molecular weight polyethylene (DSC endothermic peak: 106.7° C., Mw/Mn: 1.08) | 4 parts |

The above materials were mixed by a blender, and the mixture was melt-blended by a twin-screw extruder heated to 90° C. The blended mixture, after cooling, was crushed by a hammer mill. The coarse crushed matter was then pulverized into fine particles by a mechanical pulverizer employing a rotor at an atmosphere temperature of 45° C. The resulting fine particles were classified precisely by a multiple classifier utilizing Coanda effect to obtain toner particles.

Figure 7:
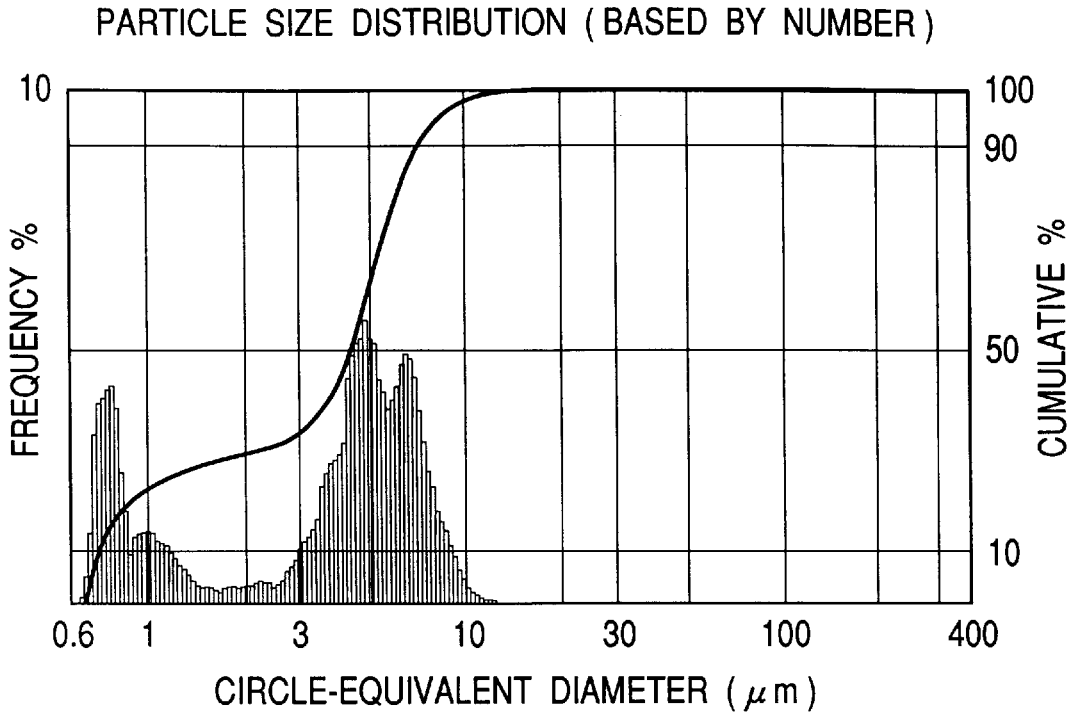
FIG. 7 is a diagram showing a particle size distribution of a toner in a third embodiment.
Figure 8:
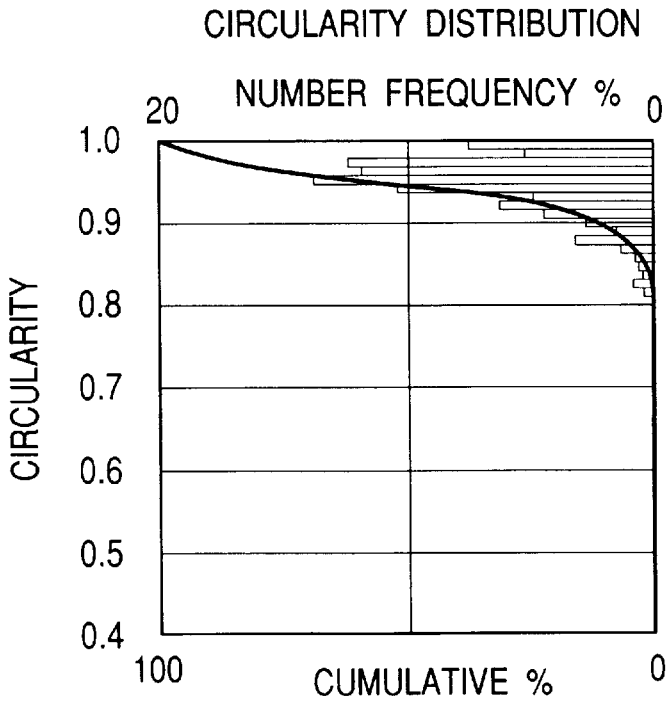
FIG. 8 is a diagram showing a circularity distribution of the toner in the third embodiment.
Figure 9:
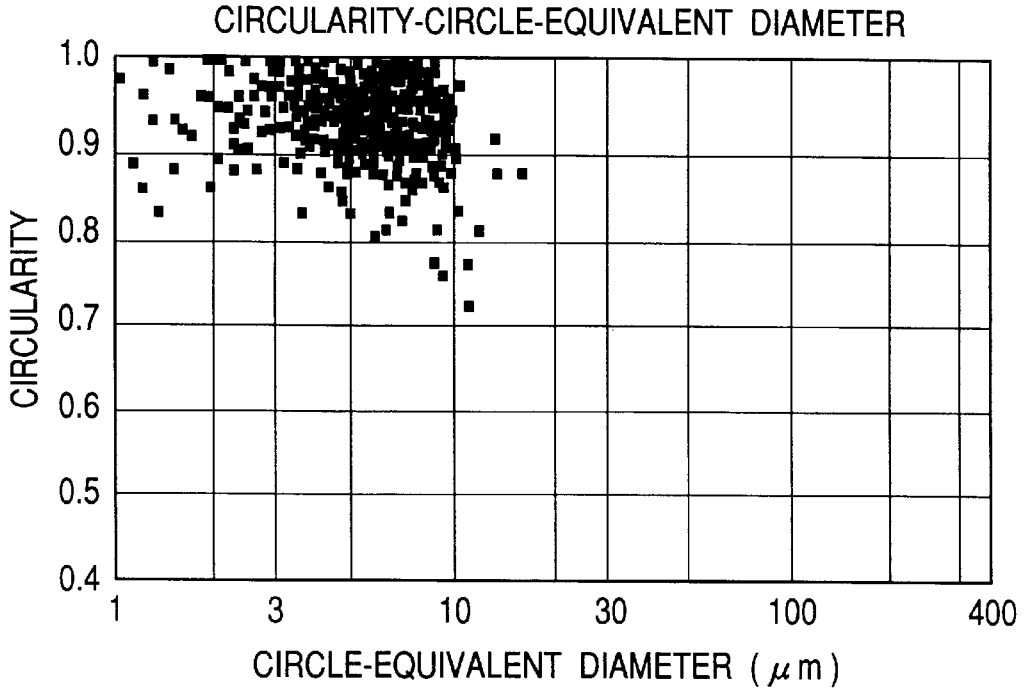
FIG. 9 is a diagram showing the relationship of the particle size distribution and the circularity distribution of the toner in the third embodiment.

To 100 parts of the obtained toner particles, was added 1.2 parts of dry type silica (primary average particle diameter: 0.015 μm) having been treated for hydrophobicity with silicone oil and hexamethyldisilazane, and the mixture was blended by a blender to obtain Toner 3. The resulting toner had a toner circularity distribution having an average circularity of 0.94, containing particles of a circularity of less than 0.95 at a content of 36.5%, and having a mode circularity of 0.96. The particle size distribution of the obtained toner had a circle-equivalent average diameter of 4.3 μm, and one peak respectively in the regions of from 0.6 to 3.0 μm and from more than 3.0 to 10.0 μm. In the particle size distribution, the particle number frequency in the region of the circular-equivalent diameter of from 0.95 to less than 3.00 μm was 13.1%. Table 5 shows the properties of obtained Toner 3. Table 4 shows the particle size frequency data of the obtained toner. FIG. 7 shows the particle size distribution of the toner. FIG. 8 shows the circularity distribution of this toner. FIG. 9 shows the correlation between the circularity and the circle-equivalent diameter.

An image was reproduced in the same manner as in Example 1 except that Toner 3 was used as the toner. As the results, the line trailing was suppressed sufficiently with no trailing edge formed on the printed lines. The toner storability was sufficient, and the toner stored at high temperature and high humidity gave a solid black image of a density of 1.51. Table 6 shows the results.

Example 4

| | |
|---|---|
| Styrene-butyl acrylate-maleic acid butyl half ester copolymer (THF-insoluble matter: 4.5%, GPC of THF-soluble matter: peak molecular weight, ca. 52000; proportion of mol. wt. of less than 50000, 52%; proportion of mol. wt. of 50000 to 500000, 27%; proportion of mol. wt. of more than 500000, 21%) | 100 parts |
| Magnetic material (shape: sphere, average particle diameter: 0.22 μm) | 100 parts |
| Monoazo dye-iron complex (average particle diameter: 1.7 μm) | 2 parts |
| Low molecular weight hydrocarbon wax (DSC endothermic peak: 111° C., Mw/Mn: 1.70) | 4 parts |

Toner particles were prepared in the same manner as in Example 1 except that the above materials were used and the coarse crushed matter was pulverized into fine particles at 35° C. by a mechanical pulverizer employing a rotor.

To 100 parts of the obtained toner particles, was added 1.2 parts of dry type silica (primary average particle diameter: 0.022 μm) having been treated for hydrophobicity with silicone oil and hexamethyldisilazane, and the mixture was blended by a blender to obtain Toner 4.

The resulting toner had a toner circularity distribution having an average circularity of 0.92, containing particles of a circularity of less than 0.95 at a content of 44.6%, and having a mode circularity of 0.93. The particle size distribution of the obtained toner had a circle-equivalent average diameter of 8.7 μm, and one peak respectively in the regions of from 0.6 to 3.0 μm and from more than 3.0 to 10.0 μm. In the particle size distribution, the particle number frequency in the region of the circular-equivalent diameter of from 0.95 to less than 3.00 μm was 8.4%. Table 5 shows the properties of obtained Toner 4.

An image was reproduced in the same manner as in Example 1 except that Toner 4 was used as the toner. As the results, the line trailing was suppressed sufficiently with occurrence of 6 trailing edges on the printed lines. The toner storability was sufficient, and the toner stored at high temperature and high humidity gave a solid black image of a density of 1.48. Table 6 shows the results.

Example 5

| | |
|---|---|
| Styrene-butyl acrylate-maleic acid butyl half ester copolymer (THF-insoluble matter: 4.8%, GPC of THF-soluble matter: peak molecular weight, ca. 50000; proportion of mol. wt. of less than 50000, 56%; proportion of mol. wt. of 50000 to 500000, 26%; proportion of mol. wt. of more than 500000, 23%) | 100 parts |
| Magnetic material (shape: sphere, average particle diameter: 0.23 μm) | 100 parts |
| Monoazo dye-iron complex (average particle diameter: 1.3 μm) | 2 parts |
| Low molecular weight hydrocarbon wax (DSC endothermic peak: 111° C., Mw/Mn: 1.70) | 4 parts |

Toner particles were prepared in the same manner as in Example 2 except that the above materials were used and the coarse crushed matter was pulverized into fine particles at 35° C. by a mechanical pulverizer employing a rotor To 100 parts of the obtained toner particles, was added 1.2 parts of dry type silica (primary average particle diameter: 0.018 μm) having been treated for hydrophobicity with silicone oil and hexamethyldisilazane, and the mixture was blended by a blender to obtain Toner 5.

The resulting toner had a toner circularity distribution having an average circularity of 0.93, containing particles of a circularity of less than 0.95 at a content of 49.3%, and having a mode circularity of 0.95. The particle size distribution of the obtained toner had a circle-equivalent average diameter of 8.2 μm, and one peak respectively in the regions of from 0.6 to 3.0 μm and from more than 3.0 to 10.0 μm. In the particle size distribution, the particle number frequency in the region of the circular-equivalent diameter of 0.95 to less than 3.00 μm was 13.1%. Table 5 shows the properties of the obtained Toner 5.

An image was reproduced in the same manner as in Example 1 except that Toner 5 was used as the toner. As the results, the line trailing was suppressed sufficiently with occurrence of 3 trailing edges on the printed lines. The toner storability was sufficient, and the toner stored at high temperature and high humidity gave a solid black image of a density of 1.49. Table 6 shows the results.

Example 6

| | |
|---|---|
| Styrene-butyl acrylate-maleic acid butyl half ester copolymer (THF-insoluble matter: 5%, GPC of THF-soluble matter: peak molecular weight, ca. 54000; proportion of mol. wt. of less than 50000, 48%; proportion of mol. wt. of 50000 to 500000, 28%; proportion of mol. wt. of more than 500000, 24%) | 100 parts |
| Magnetic material (shape: sphere, average particle diameter: 0.20 μm) | 100 parts |
| Monoazo dye-iron complex (average particle diameter: 1.8 μm) | 2 parts |
| Low molecular weight hydrocarbon wax (DSC endothermic peak: 111° C., Mw/Mn: 1.70) | 4 parts |

Toner particles were prepared in the same manner as in Example 3 except that the above materials were used and the coarse crushed matter was pulverized into fine particles at 35° C. by a mechanical pulverizer employing a rotor.

To 100 parts of the obtained toner particles, was added 1.2 parts of dry type silica (primary average particle diameter: 0.025 μm) having been treated for hydrophobicity with silicone oil and hexamethyldisilazane, and the mixture was blended by a blender to obtain Toner 6.

The resulting toner had a toner circularity distribution having an average circularity of 0.91, containing particles of a circularity of less than 0.95 at a content of 56.1%, and having a mode circularity of 0.92. The particle size distribution of the obtained toner had a circle-equivalent average diameter of 8.9 μm, and one peak respectively in the regions of from 0.6 to 3.0 μm and from more than 3.0 to 10.0 μm. In the particle size distribution, the particle number frequency in the region of the circular-equivalent diameter of 0.95 to less than 3.00 μm was 8.8%. Table 5 shows the properties of obtained Toner 6.

An image was reproduced in the same manner as in Example 1 except that Toner 6 was used as the toner. As the results, the line trailing was suppressed sufficiently with occurrence of 15 trailing edges on the printed lines. The toner storability was sufficient, and the toner stored at high temperature and high humidity gave a solid black image of a density of 1.47. Table 6 shows the results.

Example 7

Toner 1 was evaluated for image formation. An unfixed image was formed by means of LBP-430, an image formation apparatus (manufactured by Canon K. K., image formation rate of 8 sheets/min of A4-size paper in a vertical direction). The formed unfixed image was fixed with a separate fixation device which was a modification of the fixation device of LBP-430 (fixation speed: 51.4 mm/sec, pressure between fixation roller and pressing roller: 10 kg-weight). The image was reproduced under the environmental conditions of 32.5° C. and 80%RH on an image-receiving paper sheet of a basis weight of 65 g/m$^2$ which had been conditioned before the image formation at 32.5° C. and 80%RH for one day.

Trailing of the print was found to be suppressed sufficiently, and no trailing edge was found on the lines at all.

The trailing is examined as below. After reproducing of 6000 sheets of an image pattern at a print area ratio of 4%, one sheet of straight line pattern is reproduced at a line width of 4 dots and a line space of 20 dots, and the number of trailing edges is counted.

The toner could be stored satisfactorily at a high temperature and high humidity. Table 6 shows the results.

The storability of the toner under high temperature and high humidity conditions is evaluated as below. A toner is stored at 40° C. and 95%RH for 30 days. With this toner, after reproducing of 6000 sheets of image pattern at a printing area ratio of 4%, one sheet of a solid black image is reproduced. The printed image density is measured by a MacBeth reflectodensitometer (manufactured by MacBeth Co.).

Table 6 shows the results. The image density in this Example was 1.48, and was satisfactory.

Comparative Example 1

| | |
|---|---|
| Styrene-butyl acrylate-maleic acid butyl half ester copolymer (THF-insoluble matter: 5%, GPC of THF-soluble matter: peak molecular weight, ca. 72000; proportion of mol. wt. of less than 50000, 28%; proportion of mol. wt. of 50000 to 500000, 22%; proportion of mol. wt. of more than 500000, 50%) | 100 parts |
| Magnetic material (shape: sphere, average particle diameter: 0.24 μm) | 100 parts |
| Monoazo dye-iron complex (average particle diameter: 2 μm) | 2 parts |
| Low molecular weight hydrocarbon wax (DSC endothermic peak: 145° C., Mw/Mn: 8.8) | 4 parts |

The above materials were mixed by a blender, and the mixture was melt-blended at 130° C. by a twin-screw extruder. The blended mixture, after cooling, was crushed by a hammer mill. The coarse crushed matter was then pulverized into fine toner particles by a jet mill.

To 100 parts of the obtained toner particles, was added 1.2 parts of dry type silica (primary average particle diameter: 0.010 μm) having been treated for hydrophobicity with silicone oil and hexamethyldisilazane, and the mixture was blended by a blender to obtain Toner 7. The resulting toner had a circularity distribution having an average circularity of 0.80, containing particles of a circularity of less than 0.95 at a content of 70.6%, and having a mode circularity of 0.82. The particle size distribution of the obtained toner had a circle-equivalent average diameter of 12 μm, and one peak in the region of from more than 3.0 to 10.0 μm but no peak in the region of from 0.6 to 3.0 μm. In the particle size distribution, the particle number frequency in the region of the circular-equivalent diameter of from 0.95 to less than 3.00 μm was 1.5%. Table 5 shows the properties of the obtained toner.

An image was reproduced in the same manner as in Example 1 except that Toner 7 was used as the toner. As the results, the line trailing occurred significantly with 105 trailing edges formed on the printed lines. The toner storability was poor, and the toner stored at high temperature and high humidity gave a solid black image of a density of as low as 1.10. Table 6 shows the results.

Comparative Example 2

| | |
|---|---|
| Styrene-butyl acrylate-maleic acid butyl half ester copolymer (THF-insoluble matter: 5%, GPC of THF-soluble matter: peak molecular weight, ca. 68000; proportion of mol. wt. of less than 50000, 30%; proportion of mol. wt. of 50000 to 500000, 45%; proportion of mol. wt. of more than 500000, 25%) | 100 parts |
| Magnetic material (shape: sphere, average particle diameter: 0.20 μm) | 100 parts |
| Monoazo dye-iron complex (average particle diameter: 1.0 μm) | 2 parts |
| Low molecular weight hydrocarbon wax (DSC endothermic peak: 106.7° C., Mw/Mn: 1.08) | 4 parts |

The above materials were mixed by a blender, and the mixture was melt-blended at 130° C. by a twin-screw extruder. The blended mixture, after cooling, was crushed by a hammer mill. The coarse crushed matter was then pulverized into fine toner particles by a jet mill at a higher power level than that employed in Comparative Example 1.

To 100 parts of the obtained toner particles, was added 1.2 parts of dry type silica (primary average particle diameter: 0.030 μm) having been treated for hydrophobicity with silicone oil and hexamethyldisilazane, and the mixture was blended by a blender to obtain Toner 8. The resulting toner had a circularity distribution having an average circularity of 0.85, containing particles of a circularity of less than 0.95 at a content of 62.4%, and having a mode circularity of 0.84. The particle size distribution of the obtained toner had a circle-equivalent average diameter of 5.2 μm, and one peak respectively in the regions of from 0.6 to 3.0 μm and from more than 3.0 to 10.0 μm. In the particle size distribution, the particle number frequency in the region of the circular-equivalent diameter of from 0.95 to less than 3.00 μm was 5.3%. Table 5 shows the properties of the obtained Toner 8.

An image was reproduced in the same manner as in Example 1 except that Toner 8 was used as the toner. As the results, the line trailing occurred significantly with 86 trailing edges formed on the printed lines. The toner storability was good, and the toner stored at high temperature and high humidity gave a solid black image of a density of 1.48. Table 6 shows the results.

Example 8

| | |
|---|---|
| Styrene-butyl acrylate-maleic acid butyl half ester copolymer (THF-insoluble matter: 0.5%, GPC of THF-soluble matter: peak molecular weight, ca. 45000; proportion of mol. wt. of less than 50000, 55%; proportion of mol. wt. of 50000 to 500000, 35%; proportion of mol. wt. of more than 500000, 10%) | 100 parts |
| Magnetic material (shape: sphere, average particle diameter: 0.24 μm, silica-containing magnetito) | 100 parts |

-continued

| | |
|---|---|
| Monoazo dye-iron complex (average particle diameter: 1.5 μm) | 2 parts |
| Low molecular weight hydrocarbon wax (DSC endothermic peak: 104° C., Mw/Mn: 1.08) | 4 parts |

The above materials were mixed by a blender, and the mixture was melt-blended at 130° C. by a twin-screw extruder. The blended mixture, after cooling, was crushed by a hammer mill. The coarse crushed matter was then pulverized into fine particles by a pulverizing means equipped with a pneumatic classifier and an impact type pneumatic pulverizer in an atmosphere of 40° C. The resulting fine pulverized matter was precisely classified by means of a multiple classifier equipped with a forced powder dispersion device utilizing Coanda effect by feeding the powder with forcible dispersion by compressed air of 2.0 kg/cm$^2$. Thereby, a magnetic toner was produced which has an average circle-equivalent diameter of 6.2 μm, constituted of particles of circle equivalent diameter of from 0.6 μm to 1.0 μm at a content of 37% based on the particle number.

The magnetic toner particles were treated for surface modification by means of a mechanical shock type of surface-modifying apparatus to apply mechanical shock by rotation of a rotor. The obtained magnetic toner had a number-average circle-equivalent diameter of 6.4 μm, containing particles of circle-equivalent diameter of from 0.60 to less than 1.00 μm at a content of 0.7% based on the particle number, particles of circularity of not lower than 0.90 at a content of 95.2% based on particle number, and particles of a circularity of not higher than 0.98 at a content of 24.0% based on particle number.

To the magnetic toner particles, was added dry type silica of primary average particle diameter of 12 nm having been treated with silicone oil and hexamethyldisilazane for hydrophobicity in an amount of 1.2% by weight to the magnetic toner, and the mixture was blended by a blended to produce Toner 9. Table 7 shows the properties of Toner 9.

An image was reproduced in the same manner as in Example 1 except that Toner 9 was used as the toner. As the results, the line trailing was suppressed sufficiently with no trailing edge formed on the printed lines. The toner storability was sufficient, and the toner stored at high temperature and high humidity gave a solid black image of a density of 1.51. Table 8 shows the results.

Transferability of Toner 9 was evaluated by printing with Laser Beam Printer 5Si (manufactured by Hewlett Packard Co.) at a transfer bias of 10 μA at 23° C. and 65%RH. The toner transfer efficiency was measured at the start of the printing, and after 10000-sheet running test. Plain paper of a basis weight of 75 g/m$^2$ was used as the transfer-receiving paper. The transfer efficiency onto the paper sheet was sufficiently high with little variation: 92.0% at the start, and 91.7% after the 10000-sheet running test. The image quality including the image density and the fogging was stable at a high level during the 10000-sheet running test.

The toner transferability was evaluated as follows. The toner corresponding to a solid black portion on the photosensitive member was collected by Mylar adhesion tape, the tape with the toner was stuck onto a paper sheet, and the MacBeth density thereof was measured. Separately, the MacBeth density of a Mylar adhesion tape stuck on the paper sheet without the toner was measured. The difference of the MacBeth densities corresponds to the toner on the photosensitive member. This operation was conducted for the toner before the transfer and for the remaining toner after the transfer, and the transfer efficiency was derived therefrom.

Example 9

Toner 10 having the properties shown in Table 7 was produced in the same manner as in Example 8 except that the surface was treated to a higher level.

Image reproduction was conducted in the same manner as in Example 8 except that Toner 10 was used as the toner. As the results, the line trailing was suppressed sufficiently with no trailing edge formed on the printed lines. The toner storability was sufficient, and the toner stored at high temperature and high humidity gave a solid black image of a density of 1.52. Table 8 shows the results.

The transferability was evaluated in the same manner as in Example 8. The efficiency of the toner transfer from the photosensitive member to the paper sheet was 92.2% at the start and 91.3% after 10000-sheet running test with little variation during the running test. The image quality including image density and fogging was stable at a high level during the 10000-sheet running test.

Example 10

Toner 11 was produced in the same manner as in Example 8 except that the amount of the magnetic material was changed to 30 parts and the classification process was conducted twice. Table 7 shows the properties of the resulting Toner 11.

An image was reproduced in the same manner as in Example 8 except that Toner 11 was used as the toner. As the results, the line trailing was suppressed slightly with occurrence of 18 trailing edges on the printed lines. The toner storability was good, and the toner stored at high temperature and high humidity gave a solid black image of a density of 1.47. Table 8 shows the results.

The transferability was evaluated in the same manner as in Example 8. The efficiency of the toner transfer from the photosensitive member to the paper sheet was high: 91.0% at the start and 86.7% after 10000-sheet running test with a small variation. The image quality including image density and fogging was stable at a high level during the 10000-sheet running test.

Comparative Example 3

Toner 12 was produced in the same manner as in Example 8 except that the amount of the magnetic material was changed to 50 parts; the toner in the classification was fed without forced dispersion by compressed air; pulverization was conducted without heating; and the surface treatment by mechanical impact was not conducted. Table 7 shows the properties of the resulting Toner 12.

An image was reproduced in the same manner as in Example 8 except that Toner 12 was used as the toner. As the results, the trailing was not suppressed sufficiently with the line trailing occurring significantly with 46 trailing edges formed on the printed lines. The toner storability was poor, and the toner stored at high temperature and high humidity gave a solid black image of a density of as low as 1.24. Table 8 shows the results.

The transferability was evaluated in the same manner as in Example 8. The efficiency of the toner transfer from the photosensitive member to the paper sheet changed greatly during the running test: 90.0% at the start of the running test, and 79.2% after 10000-sheet running test. The image density was also lower.

Examples 11 to 13 and Comparative Example 4

An unfixed image was formed with one of Toners 9 to 12 used in Examples 8 to 10 and Comparative Example 3 by means of an image-forming apparatus LBP-930 (manufactured by Canon K. K., 24 sheets/min (A4-size)) shown in FIG. 14. The formed unfixed image was fixed by means of a separate fixing device shown in FIG. 15. Image reproducing was conducted under the conditions of 32.5° C. and 80% RH on a recording paper sheet of a basis weight of 65 g/m$^2$ which had been conditioned at 32.5° C. at 80% RH for one day. The line trailing was examined in the same manner as in Example 1.

(Constitution of external fixing device)

Fixing film: polyimide film coated with a fluororesin

Fixation speed: 35.8 mm/sec

Fixation temperature: 180° C.

Fixation pressure: 7.5 kg-weight

Table 9 shows the evaluation results.

Examples 14 to 16 and Comparative Example 5

Evaluations were made in the same manner as in Examples 11 to 13 and Comparative Example 4 except that the fixation speed was changed to 100 mm/sec. Table 9 shows the evaluation results.

Example 17

An image was formed in a single color mode with the toner used in Example 1 by means of an image-forming apparatus shown in FIG. 17. In the image-forming apparatus, a primary charging roller 202 was a rubber roller constituted of a rubber which contained electroconductive carbon dispersed therein and was coated with a nylon resin (contact pressure of 50 g/cm), and the electrostatic latent image-bearing member was an OPC photosensitive drum 201. An digital latent image was formed by laser exposure (600 dpi) with a dark area potential $V_D$ of −500 V and a light area potential $V_L$ of −160 V. To the black color developer 204-4, the developing device 151 of the image-forming apparatus shown in FIG. 14 was fitted. A digital latent image formed on the OPC photosensitive drum 201 was developed with the magnetic toner fed from the developing device 204-4 to form a toner image. This toner image was transferred from the OPC photosensitive drum 201 onto an intermediate transfer member 205 in pressure contact with the OHP photosensitive drum 201. Then the toner image on the intermediate transfer member 205 was transferred onto a transfer-receiving medium 206 by application of a voltage to a transfer roller 207 to apply a transfer current of +6 $\mu$A to the drum with pressing the transfer-receiving medium 206 against the intermediate transfer member 205 by the transfer roller 207. The toner image on the transfer-receiving medium 206 was thermally fixed by a hot-press fixation device 211 to form an image.

The hot-press fixation device had a fixation roller having an elastic layer of a silicone rubber having a surface resin layer of PFA (perfluoroalkoxyethylene), and a pressing roller in pressure contact with each other with a nip of 9.5 mm at a total pressure of 45 kgf. The fixation was conducted at a fixation speed of 117 mm/sec. The image was reproduced under conditions of 32.5° C. and 80% RH on a recording paper sheet of a basis weight of 65 g/m$^2$ which had been preliminarily conditioned at 32.5° C. and 80% RH for one day. As the results, the trailing was effectively suppressed with no line trailing edges formed on the lines. Another image formation was conducted with double transfer operations by use of the same intermediate transfer member. In this image formation also, the image quality including the fogging and the density was excellent.

TABLE 1

| Particle Size Range (μm) | Particle Size Range (μm) | Particle Size Range (μm) | Particle Size Range (μm) |
|---|---|---|---|
| 0.60–0.61 | 3.09–3.18 | 15.93–16.40 | 82.15–84.55 |
| 0.61–0.63 | 3.18–3.27 | 16.40–16.88 | 84.55–87.01 |
| 0.63–0.65 | 3.27–3.37 | 16.88–17.37 | 87.01–89.55 |
| 0.65–0.67 | 3.37–3.46 | 17.37–17.88 | 89.55–92.17 |
| 0.67–0.69 | 3.46–3.57 | 17.88–18.40 | 92.17–94.86 |
| 0.69–0.71 | 3.57–3.67 | 18.40–18.94 | 94.86–97.63 |
| 0.71–0.73 | 3.67–3.78 | 18.94–19.49 | 97.63–100.48 |
| 0.73–0.75 | 3.78–3.89 | 19.49–20.06 | 100.48–103.41 |
| 0.75–0.77 | 3.89–4.00 | 20.06–20.65 | 103.41–106.43 |
| 0.77–0.80 | 4.00–4.12 | 20.65–21.25 | 106.43–109.53 |
| 0.80–0.82 | 4.12–4.24 | 21.25–21.87 | 109.53–112.73 |
| 0.82–0.84 | 4.24–4.36 | 21.87–22.51 | 112.73–116.02 |
| 0.84–0.87 | 4.36–4.49 | 22.51–23.16 | 116.02–119.41 |
| 0.87–0.89 | 4.49–4.62 | 23.16–23.84 | 119.41–122.89 |
| 0.89–0.92 | 4.62–4.76 | 23.84–24.54 | 122.89–126.48 |
| 0.92–0.95 | 4.76–4.90 | 24.54–25.25 | 126.48–130.17 |
| 0.95–0.97 | 4.90–5.04 | 25.25–25.99 | 130.17–133.97 |
| 0.97–1.00 | 5.04–5.19 | 25.99–26.75 | 133.97–137.88 |
| 1.00–1.03 | 5.19–5.34 | 26.75–27.53 | 137.88–141.90 |
| 1.03–1.06 | 5.34–5.49 | 27.53–28.33 | 141.90–146.05 |
| 1.06–1.09 | 5.49–5.65 | 28.33–29.16 | 146.05–150.31 |
| 1.09–1.12 | 5.65–5.82 | 29.16–30.01 | 150.31–154.70 |
| 1.12–1.16 | 5.82–5.99 | 30.01–30.89 | 154.70–159.21 |
| 1.16–1.19 | 5.99–6.16 | 30.89–31.79 | 159.21–163.86 |
| 1.19–1.23 | 6.16–6.34 | 31.79–32.72 | 163.86–168.64 |
| 1.23–1.26 | 6.34–6.53 | 32.72–33.67 | 168.64–173.56 |
| 1.26–1.30 | 6.53–6.72 | 33.67–34.65 | 173.56–178.63 |
| 1.30–1.34 | 6.72–6.92 | 34.65–35.67 | 178.63–183.84 |
| 1.34–1.38 | 6.92–7.12 | 35.67–36.71 | 183.84–189.21 |
| 1.38–1.42 | 7.12–7.33 | 36.71–37.78 | 189.21–194.73 |
| 1.42–1.46 | 7.33–7.54 | 37.78–38.88 | 194.73–200.41 |
| 1.46–1.50 | 7.54–7.76 | 38.88–40.02 | 200.41–206.26 |
| 1.50–1.55 | 7.76–7.99 | 40.02–41.18 | 206.26–212.28 |
| 1.55–1.59 | 7.99–8.22 | 41.18–42.39 | 212.28–218.48 |
| 1.59–1.64 | 8.22–8.46 | 42.39–43.62 | 218.48–224.86 |
| 1.64–1.69 | 8.46–8.71 | 43.62–44.90 | 224.86–231.42 |
| 1.69–1.73 | 8.71–8.96 | 44.90–46.21 | 231.42–238.17 |
| 1.73–1.79 | 8.96–9.22 | 46.21–47.56 | 238.17–245.12 |
| 1.79–1.84 | 9.22–9.49 | 47.56–48.94 | 245.12–252.28 |
| 1.84–1.89 | 9.49–9.77 | 48.94–50.37 | 252.28–259.64 |
| 1.89–1.95 | 9.77–10.05 | 50.37–51.84 | 259.64–267.22 |
| 1.95–2.00 | 10.05–10.35 | 51.84–53.36 | 267.22–275.02 |
| 2.00–2.06 | 10.35–10.65 | 53.36–54.91 | 275.02–283.05 |
| 2.06–2.12 | 10.65–10.96 | 54.91–56.52 | 283.05–291.31 |
| 2.12–2.18 | 10.96–11.28 | 56.52–58.17 | 291.31–299.81 |
| 2.18–2.25 | 11.28–11.61 | 58.17–59.86 | 299.81–308.56 |
| 2.25–2.31 | 11.61–11.95 | 59.86–61.61 | 308.56–317.56 |
| 2.31–2.38 | 11.95–12.30 | 61.61–63.41 | 317.56–326.83 |
| 2.38–2.45 | 12.30–12.66 | 63.41–65.26 | 326.83–336.37 |
| 2.45–2.52 | 12.66–13.03 | 65.26–67.16 | 336.37–346.19 |
| 2.52–2.60 | 13.03–13.41 | 67.16–69.12 | 346.19–356.29 |
| 2.60–2.67 | 13.41–13.80 | 69.12–71.14 | 356.29–366.69 |
| 2.67–2.75 | 13.80–14.20 | 71.14–73.22 | 366.69–377.40 |
| 2.75–2.83 | 14.20–14.62 | 73.22–75.36 | 377.40–388.41 |
| 2.83–2.91 | 14.62–15.04 | 75.36–77.56 | 388.41–400.00 |
| 2.91–3.00 | 15.04–15.48 | 77.56–79.82 | |
| 3.00–3.09 | 15.48–15.93 | 79.82–82.15 | |

*The upper limit of the particle diameter range is not inclusive.

TABLE 2

| Particle Frequency of Toner 1 | | |
|---|---|---|
| Particle diameter, d (μm) | Cumulative % | Frequency % |
| 0.60 ≦ d < 0.67 | 0.19 | 0.19 |
| 0.67 ≦ d < 0.75 | 1.65 | 1.47 |
| 0.75 ≦ d < 0.84 | 4.43 | 2.78 |
| 0.84 ≦ d < 0.95 | 7.20 | 2.77 |
| 0.95 ≦ d < 1.06 | 9.08 | 1.88 |
| 1.06 ≦ d < 1.19 | 10.09 | 1.00 |
| 1.19 ≦ d < 1.34 | 10.66 | 0.57 |
| 1.34 ≦ d < 1.50 | 11.23 | 0.57 |

TABLE 2-continued

| Particle Frequency of Toner 1 | | |
|---|---|---|
| Particle diameter, d (μm) | Cumulative % | Frequency % |
| 1.50 ≦ d < 1.69 | 11.90 | 0.67 |
| 1.69 ≦ d < 1.89 | 12.36 | 0.47 |
| 1.89 ≦ d < 2.12 | 13.18 | 0.82 |
| 2.12 ≦ d < 2.38 | 13.72 | 0.54 |
| 2.38 ≦ d < 2.67 | 14.30 | 0.58 |
| 2.67 ≦ d < 3.00 | 15.31 | 1.01 |
| 3.00 ≦ d < 3.37 | 16.16 | 0.85 |
| 3.37 ≦ d < 3.78 | 17.79 | 1.63 |
| 3.78 ≦ d < 4.24 | 20.67 | 2.88 |
| 4.24 ≦ d < 4.76 | 24.97 | 4.31 |
| 4.76 ≦ d < 5.34 | 31.97 | 6.99 |
| 5.34 ≦ d < 5.99 | 43.25 | 11.28 |
| 5.99 ≦ d < 6.72 | 55.80 | 12.55 |
| 6.72 ≦ d < 7.54 | 69.41 | 13.61 |
| 7.54 ≦ d < 8.46 | 82.10 | 12.69 |
| 8.46 ≦ d < 9.49 | 91.58 | 9.48 |
| 9.49 ≦ d < 10.65 | 97.46 | 5.87 |
| 10.65 ≦ d < 11.95 | 99.51 | 2.06 |
| 11.95 ≦ d < 13.41 | 99.79 | 0.28 |
| 13.41 ≦ d < 15.04 | 99.83 | 0.04 |
| 15.04 ≦ d < 16.88 | 99.88 | 0.05 |
| 16.88 ≦ d < 18.94 | 99.89 | 0.01 |
| 18.94 ≦ d < 21.25 | 99.91 | 0.02 |
| 21.25 ≦ d < 23.84 | 99.99 | 0.09 |
| 23.84 ≦ d < 26.75 | 100.00 | 0.01 |
| 26.75 ≦ d < 30.01 | 100.00 | 0.00 |
| 30.01 ≦ d | 100.00 | 0.00 |

TABLE 3

| Particle Frequency of Toner 2 | | |
|---|---|---|
| Particle diameter, d (μm) | Cumulative % | Frequency % |
| 0.60 ≦ d < 0.67 | 1.88 | 1.88 |
| 0.67 ≦ d < 0.75 | 14.70 | 12.83 |
| 0.75 ≦ d < 0.84 | 28.57 | 13.86 |
| 0.84 ≦ d < 0.95 | 32.76 | 4.19 |
| 0.95 ≦ d < 1.06 | 36.26 | 3.50 |
| 1.06 ≦ d < 1.19 | 39.37 | 3.12 |
| 1.19 ≦ d < 1.34 | 41.15 | 1.77 |
| 1.34 ≦ d < 1.50 | 42.43 | 1.28 |
| 1.50 ≦ d < 1.69 | 43.35 | 0.92 |
| 1.69 ≦ d < 1.89 | 44.23 | 0.88 |
| 1.89 ≦ d < 2.12 | 45.18 | 0.95 |
| 2.12 ≦ d < 2.38 | 46.19 | 1.01 |
| 2.38 ≦ d < 2.67 | 47.24 | 1.05 |
| 2.67 ≦ d < 3.00 | 48.25 | 1.01 |
| 3.00 ≦ d < 3.37 | 49.39 | 1.14 |
| 3.37 ≦ d < 3.78 | 51.02 | 1.63 |
| 3.78 ≦ d < 4.24 | 52.97 | 1.95 |
| 4.24 ≦ d < 4.76 | 55.91 | 2.94 |
| 4.76 ≦ d < 5.34 | 59.85 | 3.95 |
| 5.34 ≦ d < 5.99 | 66.07 | 6.22 |
| 5.99 ≦ d < 6.72 | 73.20 | 7.13 |
| 6.72 ≦ d < 7.54 | 80.42 | 7.21 |
| 7.54 ≦ d < 8.46 | 88.71 | 8.29 |
| 8.46 ≦ d < 9.49 | 95.33 | 6.63 |
| 9.49 ≦ d < 10.65 | 98.33 | 2.99 |
| 10.65 ≦ d < 11.95 | 99.45 | 1.31 |
| 11.95 ≦ d < 13.41 | 99.84 | 0.38 |
| 13.41 ≦ d < 15.04 | 99.87 | 0.03 |
| 15.04 ≦ d < 16.88 | 99.87 | 0.00 |
| 16.88 ≦ d < 18.94 | 99.87 | 0.01 |
| 18.94 ≦ d < 21.25 | 99.92 | 0.05 |
| 21.25 ≦ d < 23.84 | 99.97 | 0.05 |
| 23.84 ≦ d < 26.75 | 100.00 | 0.03 |
| 26.75 ≦ d < 30.01 | 100.00 | 0.00 |
| 30.01 ≦ d | 100.00 | 0.00 |

TABLE 4

| Particle Frequency of Toner 2 | | |
|---|---|---|
| Particle diameter, d (μm) | Cumulative % | Frequency % |
| 0.60 ≦ d < 0.67 | 1.01 | 1.01 |
| 0.67 ≦ d < 0.75 | 7.98 | 6.97 |
| 0.75 ≦ d < 0.84 | 16.00 | 8.02 |
| 0.84 ≦ d < 0.95 | 19.41 | 3.40 |
| 0.95 ≦ d < 1.06 | 22.34 | 2.94 |
| 1.06 ≦ d < 1.19 | 24.91 | 2.57 |
| 1.19 ≦ d < 1.34 | 26.57 | 1.66 |
| 1.34 ≦ d < 1.50 | 27.59 | 1.02 |
| 1.50 ≦ d < 1.69 | 28.18 | 0.59 |
| 1.69 ≦ d < 1.89 | 28.74 | 0.56 |
| 1.89 ≦ d < 2.12 | 29.49 | 0.75 |
| 2.12 ≦ d < 2.38 | 30.38 | 0.89 |
| 2.38 ≦ d < 2.67 | 31.26 | 0.88 |
| 2.67 ≦ d < 3.00 | 32.54 | 1.28 |
| 3.00 ≦ d < 3.37 | 34.92 | 2.39 |
| 3.37 ≦ d < 3.78 | 38.59 | 3.66 |
| 3.78 ≦ d < 4.24 | 44.26 | 5.67 |
| 4.24 ≦ d < 4.76 | 53.38 | 9.12 |
| 4.76 ≦ d < 5.34 | 63.68 | 10.30 |
| 5.34 ≦ d < 5.99 | 72.59 | 8.91 |
| 5.99 ≦ d < 6.72 | 81.17 | 8.58 |

TABLE 4-continued

| Particle Frequency of Toner 2 | | |
|---|---|---|
| Particle diameter, d (μm) | Cumulative % | Frequency % |
| 6.72 ≦ d < 7.54 | 90.30 | 9.13 |
| 7.54 ≦ d < 8.46 | 95.45 | 5.15 |
| 8.46 ≦ d < 9.49 | 98.11 | 2.66 |
| 9.49 ≦ d < 10.65 | 99.24 | 1.13 |
| 10.65 ≦ d < 11.95 | 99.61 | 0.38 |
| 11.95 ≦ d < 13.41 | 99.79 | 0.17 |
| 13.41 ≦ d < 15.04 | 99.93 | 0.14 |
| 15.04 ≦ d < 16.88 | 99.97 | 0.05 |
| 16.88 ≦ d < 18.94 | 100.00 | 0.03 |
| 18.94 ≦ d < 21.25 | 100.00 | 0.00 |
| 21.25 ≦ d < 23.84 | 100.00 | 0.00 |
| 23.84 ≦ d < 26.75 | 100.00 | 0.00 |
| 26.75 ≦ d < 30.01 | 100.00 | 0.00 |
| 30.01 ≦ d | 100.00 | 0.00 |

TABLE 5

| | average circularity | particle number frequency *1 (%) | mode circularity | peak number *2 | peak number *3 | average circle-equivalent diameter (μm) | particle number frequency *4 (%) |
|---|---|---|---|---|---|---|---|
| Example | | | | | | | |
| 1 | 0.96 | 32.6 | 0.96 | 1 | 1 | 6.1 | 8.1 |
| 2 | 0.96 | 28.7 | 0.98 | 1 | 1 | 4.0 | 15.5 |
| 3 | 0.94 | 36.5 | 0.96 | 1 | 1 | 4.3 | 13.1 |
| 4 | 0.92 | 44.6 | 0.93 | 1 | 1 | 8.7 | 8.4 |
| 5 | 0.93 | 49.3 | 0.95 | 1 | 1 | 8.2 | 13.1 |
| 6 | 0.91 | 56.1 | 0.92 | 1 | 1 | 8.9 | 8.8 |
| 7 | 0.96 | 32.6 | 0.96 | 1 | 1 | 6.1 | 8.1 |
| Comparative Example | | | | | | | |
| 1 | 0.80 | 70.6 | 0.82 | 0 | 1 | 12.0 | 1.5 |
| 2 | 0.85 | 62.4 | 0.84 | 1 | 1 | 5.2 | 6.3 |

| | binder resin property *5 | | | | | wax | |
|---|---|---|---|---|---|---|---|
| | | molecular weight distribution THF soluble matter | | | | differential thermal | |
| | THF insoluble matter (wt. %) | peak molecular Mp | <50,000 (%) | 50,000 to 500,000 (%) | >50,000 (%) | analysis endothermal peak (°C.) | GPC Mw/Mn |
| Example | | | | | | | |
| 1 | 0.6 | 43000 | 50 | 42 | 8 | 106.7 | 1.08 |
| 2 | 1.5 | 41000 | 60 | 30 | 10 | 106.7 | 1.08 |
| 3 | 1.6 | 45000 | 55 | 35 | 10 | 106.7 | 1.08 |
| 4 | 4.5 | 52000 | 52 | 27 | 21 | 111.0 | 1.70 |
| 5 | 4.6 | 50000 | 56 | 26 | 23 | 111.0 | 1.70 |
| 6 | 5.0 | 54000 | 48 | 28 | 24 | 111.0 | 1.70 |
| 7 | 0.6 | 43000 | 50 | 42 | 8 | 106.7 | 1.08 |
| Comparative Example | | | | | | | |
| 1 | 5.0 | 20000 | 62 | 16 | 32 | 145.0 | 8.80 |
| 2 | 10.0 | 68000 | 30 | 45 | 25 | 106.7 | 1.08 |

TABLE 5-continued

| | binder resin property *6 | | | | |
|---|---|---|---|---|---|
| | | molecular weight distribution THF soluble matter | | | |
| | THF insoluble matter (wt. %) | peak molecular Mp | <50,000 (%) | 50,000 to 500,000 (%) | >500,000 (%) |
| Example | | | | | |
| 1 | 0.5 | 38000 | 50.6 | 42.4 | 7 |
| 2 | 1.2 | 37000 | 60.9 | 30.6 | 8.5 |
| 3 | 1.2 | 40000 | 55.8 | 35.7 | 8.5 |
| 4 | 3.6 | 47000 | 52.5 | 27.5 | 20 |
| 5 | 3.9 | 45000 | 56.6 | 26.4 | 22 |
| 6 | 4.0 | 49000 | 48.7 | 28.3 | 23 |
| 7 | 0.5 | 38000 | 50.6 | 42.4 | 7 |
| Comparative Example | | | | | |
| 1 | 4.0 | 18000 | 62.4 | 16.6 | 31 |
| 2 | 8.0 | 65000 | 30.8 | 45.2 | 24 |

particle number frequency *1: particle number frequency of particles with circularity of less than 0.95
peak number *2: number of peak of particle number frequency in region of circle-equivalent diameter of 0.6 to 3.0 μm
peak number *3: number of peak of particle number frequency in region of circle-equivalent diameter of more than 3.0 to not more than 10.0 μm
particle number frequency *4: particle number frequency in region of circle-equivalent diameter of 0.95 to less than 3.00 μm
binder resin property *5: property of binder resin used for toner particle
binder resin property *6: property of binder resin constituting toner particle

TABLE 6

| | number of smeared image trailing edge of line image-reproduced under high temperature and high humidity | solid black image density after durability test using a toner which is placed under high temperature and high humidity |
|---|---|---|
| Example 1 | 0 | 1.50 |
| Example 2 | 0 | 1.52 |
| Example 3 | 0 | 1.51 |
| Example 4 | 6 | 1.48 |
| Example 5 | 3 | 1.49 |
| Example 6 | 15 | 1.47 |
| Example 7 | 0 | 1.48 |
| Comparative Example 1 | 105 | 1.10 |
| Comparative Example 2 | 86 | 1.48 |

TABLE 7

| | average circularity | particle number frequency *1 (%) | mode circularity | peak number *2 | peak number *3 | average circle-equivalent diameter (μm) | particle number frequency *4 (%) | particle ratio *7 (number-based %) | particle number *8 (%) | particle number *9 (%) |
|---|---|---|---|---|---|---|---|---|---|---|
| Example | | | | | | | | | | |
| 8 | 0.95 | 30.7 | 0.96 | 1 | 1 | 6.4 | 8.0 | 0.7 | 95.2 | 24.0 |
| 9 | 0.96 | 27.3 | 0.97 | 1 | 1 | 4.9 | 8.3 | 0.5 | 96.8 | 25.4 |
| 10 | 0.91 | 38.6 | 0.92 | 1 | 1 | 6.2 | 5.0 | 3.7 | 90.9 | 12.5 |
| Comparative Example | | | | | | | | | | |
| 3 | 0.88 | 68.6 | 0.89 | 0 | 1 | 5.3 | 6.5 | 6.5 | 86.3 | 11.5 |

TABLE 7-continued

| | binder resin property *5 | | | | | wax | |
|---|---|---|---|---|---|---|---|
| | | molecular weight distribution THF soluble matter | | | | differential thermal analysis | |
| | THF insoluble matter (wt. %) | peak molecule Mp | <50,000 (%) | 50,000 to 500,000 (%) | >500,000 (%) | endothermal peak (°C.) | GPC Mw/Mn |
| Example | | | | | | | |
| 8 | 0.5 | 45000 | 55 | 35 | 10 | 104.0 | 1.08 |
| 9 | 0.5 | 45000 | 55 | 35 | 10 | 104.0 | 1.08 |
| 10 | 0.5 | 45000 | 55 | 35 | 10 | 104.0 | 1.08 |
| Comparative Example | | | | | | | |
| 3 | 0.5 | 45000 | 55 | 35 | 10 | 104.0 | 1.08 |

| | binder resin property *6 | | | | |
|---|---|---|---|---|---|
| | | molecular weight distribution THF soluble matter | | | |
| | THF insoluble matter (wt. %) | peak molecular Mp | <50,000 (%) | 50,000 to 500,000 (%) | >500,000 (%) |
| Example | | | | | |
| 8 | 0.4 | 41000 | 55.7 | 35.3 | 9 |
| 9 | 0.4 | 41000 | 55.4 | 35.6 | 9 |
| 10 | 0.4 | 40000 | 55.1 | 35.9 | 9 |
| Comparative Example | | | | | |
| 3 | 0.4 | 39000 | 55.6 | 35.6 | 8.8 |

particle ratio *7: particel ratio of particle having circle-equivalent diameter of not less than 0.60 to less than 1.00 μm (number-based %)
particle number *8: particle number of particle having circularity of not less than 0.90
particle number *9: particle number of particle having circularity of not less than 0.98

TABLE 8

| | number of smeared image trailing edge of line image-reproduced under high temperature and high humidity | solid black image density after durability test using a toner which is placed under high temperature and high humidity | initial transfer efficiency (%) | transfer efficiency after copying of 10,000 sheets (%) | fluctuation of transfer efficiency (%) |
|---|---|---|---|---|---|
| Example 8 | 0 | 1.51 | 92.0 | 91.7 | 0.3 |
| Example 9 | 0 | 1.52 | 92.2 | 91.3 | 0.9 |
| Example 10 | 18 | 1.47 | 91.5 | 89.9 | 1.6 |
| Comparative Example 3 | 46 | 1.24 | 90.0 | 79.2 | 10.8 |

TABLE 9

| | fixing speed (mm/sec) | number of smeared image trailing edge of line image-reproduced under high temperature and high humidity |
|---|---|---|
| Example 11 | 35.8 | 0 |
| Example 12 | 35.8 | 0 |
| Example 13 | 35.8 | 20 |
| Comparative Example 4 | 35.8 | 50 |
| Example 14 | 100 | 0 |
| Example 15 | 100 | 0 |
| Example 16 | 100 | 24 |
| Comparative Example 5 | 100 | 62 |

What is claimed is:

1. A toner for forming an image which comprises:

toner particles containing at least a colorant, a binder resin and a wax, wherein the toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm;

the wax has an endothermic main peak as measured by DSC of 60 to 120° C., and the binder resin contains THF soluble matter and 0 to 5.0% by weight of THF insoluble matter, said THF soluble matter having a molecular-weight distribution as measured by GPC in which the THF soluble matter has a content (M1) of 40 to 70% of a component with a molecular weight of less than 50,000, a content (M2) of 20 to 45% of a component with a molecular weight of 50,000 to 500,000, and a content (M3) of 2 to 25% of a component with a molecular weight exceeding 500,000 and the following condition (1) is satisfied:

$$M1 \geqq M2 > M3. \quad (1)$$

2. The toner according to claim 1, wherein the toner has a particle size distribution in a circle-equivalent diameter in which the toner contains 2 to 50% by number of particles with a circle-equivalent diameter of 0.95 μm to less than 3.00 μm.

3. The toner according to claim 1, wherein the toner has a particle size distribution in a circle-equivalent diameter in which the toner contains 5 to 40% by number of particles with a circle-equivalent diameter of 0.95 μm to less than 3.00 μm.

4. The toner according to claim 1, wherein the toner has a particle size distribution in a circle-equivalent diameter in which the toner contains 0 to less than 5.0% by number of particles with a circle-equivalent diameter of 0.60 μm to less than 1.00 μm.

5. The toner according to claim 1, wherein the toner has a particle size distribution in a circle-equivalent diameter in which the toner contains 90% by number or more of particles with a circularity of 0.90 or more and 0 to 30.0% by number of particles with a circularity of 0.98 or more.

6. The toner according to claim 1, wherein in a molecular weight distribution as measured by GPC, the wax has a ratio (Mw/Mn) of 1.0 to 2.0 between a weight-average particle diameter (Mw) and a number-average particle diameter (Mn).

7. The toner according to claim 1, wherein the toner comprises the toner particles and external additive particles.

8. The toner according to claim 1, wherein the external additive particles have a fine inorganic powder.

9. The toner according to claim 1, wherein the toner comprises at least the toner particles and a fine inorganic powder, and the toner particles have a particle size distribution in a circle-equivalent diameter in which the toner particles contain 0 to 5.0% by number of particles with a circle-equivalent diameter of 0.60 μm to less than 1.00 μm and have a circle-equivalent diameter average diameter of 4.0 to 10.0 μm.

10. The toner according to claim 1, wherein the toner particles are manufactured by subjecting a toner material including at least the colorant, the binder resin and the wax to a kneading process, a grinding process and a classification process.

11. The toner according to claim 10, wherein in the manufacture process the toner particles are subjected to a process for reducing the number of particles with a circle-equivalent diameter of less than 1.00 μm.

12. The toner according to claim 11, wherein the process for reducing the number of the particles with the circle-equivalent diameter of less than 1.00 μm means that a wind force classification is performed by using a compressed gas in the classification process in such a manner that the toner particles to be classified are forced to be dispersed.

13. The toner according to claim 11, wherein the process for reducing the number of the particles with the circle-equivalent diameter of less than 1.00 μm means that the classification process of the toner particles is repeated several times.

14. The toner according to claim 11, wherein the process for reducing the number of the particles with the circle-equivalent diameter of less than 1.00 μm means that by applying a mechanical impact force to the toner particles, the particles with the circle-equivalent diameter of less than 1.00 μm are caused to adhere to surfaces of particles with a circle-equivalent diameter of 1.00 μm or more in the classification process.

15. The toner according to claim 1, wherein in the circularity distribution of particles with the circle-equivalent diameter of 3.00 μm or more, the toner particles contain 90% by number or more of particles with the circularity of 0.900 or more and 0 to 30% by number of particles with the circularity of 0.980 or more.

16. The toner according to claim 1, wherein the toner has magnetic toner particles which contain magnetic substances as the colorant.

17. The toner according to claim 16, wherein the magnetic toner particles contain 30 to 200 parts by weight of the magnetic substances relative to 100 parts by weight of the binder resin.

18. An image forming method which comprises the steps of:

a latent image forming process for forming an electrostatic latent image on an electrostatic latent image holding member;

a development process for developing the electrostatic latent image held by the electrostatic latent image holding member with a toner to form a toner image;

a transfer process for transferring the toner image to a recording material via or not via an intermediate transfer member; and a fixing process for fixing onto the recording material the toner image transferred to the recording material, wherein the toner comprises toner particles containing at least a colorant, a binder resin and a wax, the toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm, the wax has an endothermic main peak as measured by DSC of 60 to 120° C., and the binder resin contains THF soluble matter and 0 to 5.0% by weight of THF insoluble matter, the THF soluble content having a molecular-weight distribution as measured by GPC in which the THF soluble content has a content (M1) of 40 to 70% of a component with a molecular weight of less than 50,000, a content (M2) of 20 to 45% of a component with a molecular weight of 50,000 to 500,000 and a content (M3) of 2 to 25% of a component with a molecular weight exceeding 500,000 and the following condition (1) is satisfied:

$$M1 \geqq M2 > M3. \quad (1)$$

19. The image forming method according to claim 18, wherein the toner has a particle size distribution in a circle-equivalent diameter in which the toner has an average circularity of 0.930 to less than 0.960, contains 20 to 50% by number of particles with a circularity of less than 0.95 and has a circularity distribution with a mode circularity of 0.93 or more.

20. The image forming method according to claim 18, wherein the toner has a particle size distribution in a circle-equivalent diameter in which the toner contains 2 to 50% by number of particles with a circle-equivalent diameter of 0.95 μm to less than 3.00 μm.

21. The image forming method according to claim 18, wherein the toner has a particle size distribution in a circle-equivalent diameter in which the toner contains 5 to 40% by number of particles with a circle-equivalent diameter of 0.95 μm to less than 3.00 μm.

22. The image forming method according to claim 18, wherein the toner has a particle size distribution in a circle-equivalent diameter in which the toner contains 0 to less than 5.0% by number of particles with a circle-equivalent diameter of 0.60 μm to less than 1.00 μm.

23. The image forming method according to claim 18, wherein in a molecular weight distribution as measured by GPC, the wax has a ratio (Mw/Mn) of 1.0 to 2.0 between a weight-average particle diameter (Mw) and a number-average particle diameter (Mn).

24. The image forming method according to claim 18, wherein the toner comprises the toner particles and external additive particles.

25. The image forming method according to claim 24, wherein the external additive particles have a fine inorganic powder.

26. The image forming method according to claim 18, wherein the toner comprises at least the toner particles and a fine inorganic powder, and the toner particles have a particle size distribution in a circle-equivalent diameter in which the toner particles contain 0 to 5.0% by number of particles with a circle-equivalent diameter of 0.60 μm to less than 1.00 μm and have a circle-equivalent diameter average diameter of 4.0 to 10.0 μm.

27. The image forming method according to claim 18, wherein the toner particles are manufactured by subjecting a toner material including at least the colorant, the binder resin and the wax to a kneading process, a grinding process and a classification process.

28. The image forming method according to claim 27, wherein in the manufacture process the toner particles are subjected to a process for reducing the number of particles with a circle-equivalent diameter of less than 1.00 μm.

29. The image forming method according to claim 28, wherein the process for reducing the number of the particles with the circle-equivalent diameter of less than 1.00 μm means that wind force classification is performed by using a compressed gas in the classification process in such a manner that the toner particles to be classified are forced to be dispersed.

30. The image forming method according to claim 28, wherein the process for reducing the number of the particles with the circle-equivalent diameter of less than 1.00 μm means that the classification process of the toner particles is repeated several times.

31. The image forming method according to claim 28, wherein the process for reducing the number of the particles with the circle-equivalent diameter of less than 1.00 μm means that by applying a mechanical impact force to the toner particles, the particles with the circle-equivalent diameter of less than 1.00 μm are caused to adhere to surfaces of particles with a circle-equivalent diameter of 1.00 μm or more in the classification process.

32. The image forming method according to claim 18, wherein in the circularity distribution of particles with the circle-equivalent diameter of 3.00 μm or more, the toner particles contain 90% by number or more of particles with the circularity of 0.900 or more and 0 to 30% by number of particles with the circularity of 0.980 or more.

33. The image forming method according to claim 18, wherein the toner has magnetic toner particles which contain magnetic substances as the colorant.

34. The image forming method according to claim 33, wherein the magnetic toner particles contain 30 to 200 parts by weight of the magnetic substances relative to 100 parts by weight of the binder resin.

35. The image forming method according to claim 18, wherein in a development section in the development process, a thickness of a toner layer carried on the toner carrier is thinner than an interval between the electrostatic latent image holding member and the toner carrier, and the toner layer carried by the toner carrier develops the electrostatic latent image formed on the electrostatic latent image holding member in a non-contact condition.

36. The image forming method according to claim 35, wherein in the development process, by applying a bias voltage to the toner carrier, the electrostatic latent image formed on the electrostatic latent image holding member is developed.

37. The image forming method according to claim 18, wherein the electrostatic latent image holding member is an electrophotography photosensitive member.

38. The image forming method according to claim 18, wherein in the fixing process by using a fixing device which has a fixing roller having a heating means and a pressure roller for pressing against the fixing roller, the recording material having the toner image is passed through a pressed portion between the fixing roller and the pressure roller to heat-fix the toner image onto the recording material.

39. The image forming method according to claim 38, wherein the pressure roller has no heating means.

40. The image forming method according to claim 38, wherein the pressure roller has a heating means.

41. The image forming method according to claim 18, wherein in the fixing process by using a fixing device which has a fixing film for contacting with the toner image on the recording material, a heating means for heating the fixing film and a pressure member for pressing a face having the toner image on the recording material onto the fixing film, the toner image is heated by the heated fixing film and the toner-image face of the recording material is pressed onto the fixing film by the pressure member to heat-fix the toner image onto the recording material.

42. The image forming method according to claim 18, wherein in the transfer process the toner image on the electrostatic latent image holding member is transferred directly to the recording material not via the intermediate transfer member.

43. The image forming method according to claim 18, wherein in the transfer process the toner image on the electrostatic latent image holding member is transferred to the intermediate transfer member and thereafter transferred from the intermediate transfer member to the recording material.

44. A heat-fixing method which comprises the steps of:

an image forming process for forming a toner image with a toner on a recording material; and a fixing process for heat-fixing onto the recording material the toner image formed on the recording material, wherein the toner comprises toner particles containing at least a colorant, a binder resin and a wax, the toner has:

(i) a circularity distribution in which the toner has an average circularity of 0.900 to less than 0.965, contains 20 to 60% by number of particles with a circularity of less than 0.95 and has a mode circularity of 0.90 or more, and (ii) a particle size distribution in which the toner has a circle-equivalent average diameter of 2.0 to 10.0 μm and has at least one peak of frequency by number in the region of a circle-equivalent diameter of 0.6 to 3.0 μm and at least one peak of frequency by number in the region of a circle-equivalent diameter of from more than 3.0 μm to 10.0 μm, the wax has an endothermic main peak as measured by DSC of 60 to 120° C., and the binder resin contains THF soluble matter and 0 to 5.0% by weight of THF insoluble matter, said THF soluble matter having a molecular-weight distribution as measured by GPC in which the THF soluble matter has a content (M1) of 40 to 70% of a component with a molecular weight of less than 50,000, a content (M2) of 20 to 45% of a component with a molecular weight of 50,000 to 500,000 and a content (M3) of 2 to 25% of a component with a molecular weight exceeding 500,000 and the following condition (1) is satisfied:

$$M1 \geqq M2 > M3. \quad (1)$$

45. The heat-fixing method according to claim 44, wherein the toner has a particle size distribution in a circle-equivalent diameter in which the toner has an average circularity of 0.930 to less than 0.960, contains 20 to 50% by number of particles with a circularity of less than 0.95 and has a circularity distribution with a mode circularity of 0.93 or more.

46. The heat-fixing method according to claim 44, wherein the toner has a particle size distribution in a circle-equivalent diameter in which the toner contains 2 to 50% by number of particles with a circle-equivalent diameter of 0.95 μm to less than 3.00 μm.

47. The heat-fixing method according to claim 44, wherein the toner has a particle size distribution in a circle-equivalent diameter in which the toner contains 5 to 40% by number of particles with a circle-equivalent diameter of 0.95 μm to less than 3.00 μm.

48. The heat-fixing method according to claim 44, wherein the toner has a particle size distribution in a circle-equivalent diameter in which the toner contains 0 to less than 5.0% by number of particles with a circle-equivalent diameter of 0.60 μm to less than 1.00 μm.

49. The heat-fixing method according to claim 44, wherein in a molecular weight distribution as measured by GPC, the wax has a ratio (Mw/Mn) of 1.0 to 2.0 between a weight-average particle diameter (Mw) and a number-average particle diameter (Mn).

50. The heat-fixing method according to claim 44, wherein the toner comprises the toner particles and external additive particles.

51. The heat-fixing method according to claim 50, wherein the external additive particles have a fine inorganic powder.

52. The heat-fixing method according to claim 51, wherein the toner comprises at least the toner particles and a fine inorganic powder, and the toner particles have a particle size distribution in a circle-equivalent diameter in which the toner particles contain 0 to 5.0% by number of particles with a circle-equivalent diameter of 0.60 μm to less than 1.00 μm and have a circle-equivalent diameter average diameter of 4.0 to 10.0 μm.

53. The heat-fixing method according to claim 44, wherein the toner particles are manufactured by subjecting a toner material including at least the colorant, the binder resin and the wax to a kneading process, a grinding process and a classification process.

54. The heat-fixing method according to claim 53, wherein in the manufacture process the toner particles are subjected to a process for reducing the number of particles with a circle-equivalent diameter of less than 1.00 μm.

55. The heat-fixing method according to claim 54, wherein the process for reducing the number of the particles with the circle-equivalent diameter of less than 1.00 μm means that a wind force classification is performed by using a compressed gas in the classification process in such a manner that the toner particles to be classified are forced to be dispersed.

56. The heat-fixing method according to claim 54, wherein the process for reducing the number of the particles with the circle-equivalent diameter of less than 1.00 μm means that the classification process of the toner particles is repeated several times.

57. The heat-fixing method according to claim 54, wherein the process for reducing the number of the particles with the circle-equivalent diameter of less than 1.00 μm means that by applying a mechanical impact force to the toner particles, the particles with the circle-equivalent diameter of less than 1.00 μm are caused to adhere to surfaces of particles with a circle-equivalent diameter of 1.00 μm or more in the classification process.

58. The heat-fixing method according to claim 44, wherein in the circularity distribution of particles with the circle-equivalent diameter of 3.00 μm or more, the toner particles contain 90% by number or more of particles with the circularity of 0.900 or more and 0 to 30% by number of particles with the circularity of 0.980 or more.

59. The heat-fixing method according to claim 44, wherein the toner has magnetic toner particles which contain magnetic substances as the colorant.

60. The heat-fixing method according to claim 59, wherein the magnetic toner particles contain 30 to 200 parts by weight of the magnetic substances relative to 100 parts by weight of the binder resin.

61. The heat-fixing method according to claim 44, wherein in the fixing process by using a fixing device which has a fixing roller having a heating means and a pressure roller for pressing against the fixing roller, the recording material having the toner image is passed through a pressed portion between the fixing roller and the pressure roller to heat-fix the toner image onto the recording material.

62. The heat-fixing method according to claim 61, wherein the pressure roller has no heating means.

63. The heat-fixing method according to claim 61, wherein the pressure roller has a heating means.

64. The heat-fixing method according to claim 61, wherein in the fixing process by using a fixing device which has a fixing film for contacting with on the toner image on the recording material, a heating means for heating the fixing film and a pressure member for pressing a face having the toner image on the recording material onto the fixing film, the toner image is heated by the heated fixing film and the toner-image face of the recording material is pressed onto the fixing film by the pressure member to heat-fix the toner image onto the recording material.

* * * * *

UNITED STATES PATENT AND TRADEMARK OFFICE

CERTIFICATE OF CORRECTION

PATENT NO. : 5,912,101

DATED : June 15, 1999

INVENTOR(S): YUKI KARAKI, ET AL.

It is certified that error appears in the above-identified patent and that said Letters Patent is hereby corrected as shown below:

COVER PAGE AT ITEM [57] ABSTRACT:
Line 18, "5% or less" should read --40% to 70%--.

COLUMN 1:
Line 40, "have" should read --had--; and
Line 58, "tend" should read --tends--.

COLUMN 3:
Line 40, "O" should read --0--.

COLUMN 4:
Line 64, "DRAWING" should read --DRAWINGS--.

COLUMN 6:
Line 23, "9.965" should read --0.965--.

COLUMN 10:
Line 16, "a nd" should read --and--; and
Line 39, "other many" should read --many other--.

COLUMN 11:
Line 9, "a of" should read --of--;
Line 38, "Ca." should read --ca.--; and
Line 66, "Coalter" should read --Coulter--.

UNITED STATES PATENT AND TRADEMARK OFFICE

CERTIFICATE OF CORRECTION

PATENT NO. : 5,912,101

DATED : June 15, 1999

INVENTOR(S): YUKI KARAKI, ET AL.

It is certified that error appears in the above-identified patent and that said Letters Patent is hereby corrected as shown below:

COLUMN 13:
Line 55, "which" should read --by which the--.

COLUMN 15:
Line 3, "electro" should read --electron--;
Line 5, "electro" should read --electron--;
Line 9, "is" should read --are--;
Line 10, "is" should read --are--;
Line 35, "internal" should read --internally--, and "external" should read --externally--; and
Line 55, "teterafluoroberate" should read --tetrafluoroborate--.

COLUMN 16:
Line 55, "from" should be deleted.

COLUMN 18:
Line 37, "the the" should read --the--.

COLUMN 19:
Line 65, "image" should read --image is formed--.

UNITED STATES PATENT AND TRADEMARK OFFICE

CERTIFICATE OF CORRECTION

PATENT NO. : 5,912,101

DATED : June 15, 1999

INVENTOR(S): YUKI KARAKI, ET AL.

It is certified that error appears in the above-identified patent and that said Letters Patent is hereby corrected as shown below:

COLUMN 22:
Line 58, "next" should read --the next--.

COLUMN 28:
Line 37, "acrylate-maleic acid butyl half ester" should read --acrylate-divinyl benzene--; and
Line 47, "hydrocarbon wax" should read --polypropylene-.

COLUMN 29:
Line 14, "acrylate-maleic acid butyl half ester" should read --acrylate-divinyl benzene--;
Line 16, "5%," should read --10%--;
Line 24, "hydrocarbon wax" should read --polyethylene--; and
Line 66, "magnetito)" should read --magnetite--.

COLUMN 30:
Line 3, "(average" should read --(negative chargeable controlling agent, average--;
Line 4, "hydrocarbon wax" should read --polyethylene--; and
Line 37, "a blended" to -- by a blended -- to be deleted.

UNITED STATES PATENT AND TRADEMARK OFFICE

CERTIFICATE OF CORRECTION

PATENT NO. : 5,912,101

DATED : June 15, 1999

INVENTOR(S): YUKI KARAKI, ET AL.

It is certified that error appears in the above-identified patent and that said Letters Patent is hereby corrected as shown below:

COLUMN 32:
Line 35, "An" should read --A--.

COLUMN 39:
Line 30, "particel" should read --particle--.

COLUMN 41:
Line 35, "claim 1," should read --claim 7,--.

Signed and Sealed this

Twenty-eighth Day of March, 2000

*Attest:*

Q. TODD DICKINSON

*Attesting Officer*

*Commissioner of Patents and Trademarks*